US007008254B2

(12) United States Patent
Matsunaga et al.

(10) Patent No.: US 7,008,254 B2
(45) Date of Patent: Mar. 7, 2006

(54) CONNECTOR

(75) Inventors: Hideki Matsunaga, Yokkaichi (JP); Kenji Okamura, Yokkaichi (JP); Hiroshi Nakano, Yokkaichi (JP); Eiji Kojima, Yokkaichi (JP); Masaaki Tabata, Yokkaichi (JP); Tetsuya Aihara, Yokkaichi (JP); Hiroyoshi Maesoba, Yokkaichi (JP); Toshifumi Ichio, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/028,097

(22) Filed: Jan. 3, 2005

(65) Prior Publication Data

US 2005/0148229 A1 Jul. 7, 2005

(30) Foreign Application Priority Data

Jan. 5, 2004 (JP) ..... 2004-000624
Jan. 9, 2004 (JP) ..... 2004-004667

(51) Int. Cl.
*H01R 13/627* (2006.01)

(52) U.S. Cl. ..... 439/352

(58) Field of Classification Search ..... 439/352, 439/353, 354–358, 489, 595, 607–609, 108
See application file for complete search history.

(56) References Cited

U.S. PATENT DOCUMENTS

RE31,142 E * 2/1983 Simmons ..... 439/586
5,013,262 A * 5/1991 Shibano ..... 439/610
5,171,161 A * 12/1992 Kachlic ..... 439/352
5,637,014 A 6/1997 Sukegawa et al.
6,045,404 A 4/2000 Myer
6,146,182 A 11/2000 Wang et al.
6,439,897 B1 8/2002 Ikeya

FOREIGN PATENT DOCUMENTS

| | | |
|---|---|---|
| EP | 0 933 835 A2 | 1/1999 |
| JP | 03-120742 | 5/1991 |
| JP | 5-68085 | 9/1993 |
| JP | 6-267611 | 9/1994 |
| JP | 9-017539 | 1/1997 |
| JP | 10-32043 | 2/1998 |
| JP | 10-321292 | 12/1998 |
| JP | 11-211755 | 8/1999 |
| JP | 11-326379 | 11/1999 |
| JP | 2000-214216 | 8/2000 |
| JP | 2001-013207 | 1/2001 |
| JP | 2002-367725 | 12/2002 |

* cited by examiner

*Primary Examiner*—Alexander Gilman
(74) *Attorney, Agent, or Firm*—Gerald E. Hespos; Anthony J. Casella

(57) ABSTRACT

A female housing (20) made of a synthetic resin is formed with cavities (22) for accommodating female terminal fittings (21), and locks (24) engageable with the female terminal fittings (21) to retain them are provided in the cavities (22). Each lock (24) projects from an outer surface (20*a*, 20*b*) of the female housing (20) during resilient deformation. A lock arm (40) for holding a mating male connector (M) in a connected state is mounted on the female housing (20). The lock arm (40) is made of metal and includes a press-in portion (42) that can be pressed into press-in grooves (30) of the female housing (20). The lock arm (40) is arranged to face the locks (240) and can be retracted into deformation spaces (330) for the locks (240) during the resilient deformation.

8 Claims, 25 Drawing Sheets

CONNECTOR

BACKGROUND OF THE INVENTION

1. Field of the Invention

The present invention relates to a connector with a lock arm.

2. Description of the Related Art

Japanese Unexamined Patent Publication No. H07-282884 discloses a connector with a lock arm for holding a mating connector in a connected state. This connector has a housing and the lock arm is cantilevered from the front of the upper surface of the housing. The lock arm engages an engaging portion of the mating connector to hold the connectors in a connected state.

The housing is made of a synthetic resin and is molded integrally with the lock arm. A portion of the lock arm projects up from the housing and tends to enlarge the connector in a height direction.

Japanese Unexamined Patent Publication No. H05-182712 and FIG. 25 herein show another connector with a lock arm. With reference to FIG. 25, this connector has a male housing 1 with a receptacle 2 for receiving a female housing 3. A lock arm 4 is cantilevered integrally from the upper surface of the female housing 3 and is engageable with an engaging portion 5 on an upper part 2*a* of the receptacle 2 to hold the two housings 1, 3 in their connected state. However, this connector also is large along the height direction since the lock arm 4 and the upper part 2*a* of the receptacle 2 are placed one over the other in the connected state.

The invention was developed in view of the above problem and an object thereof is to provide a connector suitable for the miniaturization.

SUMMARY OF THE INVENTION

The invention relates to a connector with a housing made of a synthetic resin, and a lock arm for holding a mating connector in a connected state. The lock arm is made of metal and is held pressingly on the housing so that at least partly of the lock arm is in a recess in the housing. Thus, a projecting height of the lock arm from the housing can be reduced as compared to prior art connectors that have a housing molded integrally with a lock arm. As a result, the connector can be miniaturized.

The housing has at least one cavity for at least one terminal fitting. Each cavity has a resiliently deformable lock that engages the terminal fitting to retain the terminal fitting in the cavity. The lock preferably project from an outer surface of the housing during the deformation. The lock projects from the outer surface of the housing if the terminal fitting is left insufficiently inserted in the cavity. Thus, insufficient insertion of the terminal fitting can be detected visually. The lock arm preferably is mounted on the outer surface of the housing from which the lock can project and is mounted after the terminal fittings are inserted. Thus, the lock arm does not hinder visual confirmation of the lock.

The lock arm preferably faces the locks and can be retracted into deformation spaces for the locks during the resilient deformation. Thus, the lock arm and the locks share the same deformation space and the connector can be miniaturized further as compared to connectors that have separate deformation spaces for the locks and the lock arm.

The lock arm preferably has at least one press-in portion that projects down towards the housing. The housing has at least one press-in groove for receiving the press-in portion of the lock arm. Thus, the lock arm can be mounted easily on the housing.

The housing preferably has a receptacle for receiving the mating connector and the lock arm is engageable with an engaging portion of the mating connector to hold the mating connector in a connected state.

The lock arm may be in a lock-arm arranging space recessed the receptacle.

The lock arm may undergo a seesaw-like displacement. A lock may be at one end of the lock arm and may engage an engaging portion of the mating connector. An operable portion may be at an opposite end of the lock arm and may be operated to incline the lock arm and disengage the lock from the engaging portion.

A metallic reinforcement may cover at least part of an outer surface of the housing where the lock-arm arranging space is formed. The reinforcement compensates for a reduced strength of the housing attributable to the lock-arm arranging space. The construction is simplified by forming the lock arm unitarily with the reinforcement.

The housing may be configured for being fixed to an electric or electronic device, such as a circuit board. The reinforcement preferably is integral or unitary with a board-fixing portion to be fixed to the electric or electronic device, thereby further simplifying the construction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
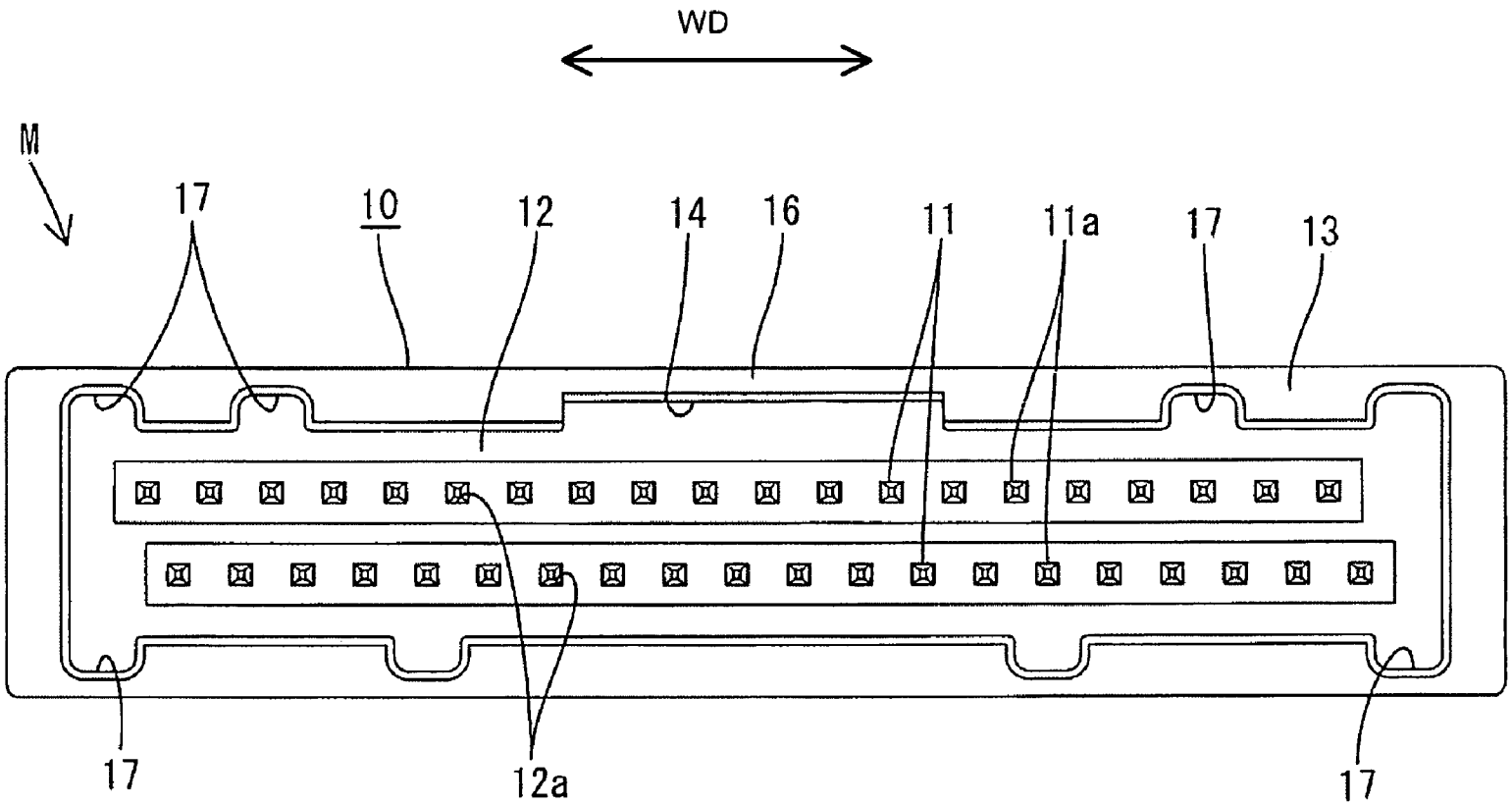
FIG. 1 is a front view of a male connector according to a first embodiment of the invention.

A first embodiment of the invention is described with reference to FIGS. 1 to 11, and includes a female connector F that is connectable with a mating male connector M along a connecting direction CD. In the following description, sides of the two connectors F, M to be connected with each other are referred to as the front, and reference is made to all the figures except FIG. 4 concerning vertical direction. The terms upper, lower, top and bottom are used herein as a convenient frame of reference, but are not intended to imply a required gravitational orientation The male connector M is configured for mounting on a circuit board K, as shown in FIGS. 1 and 8, and is secured on the circuit board K by unillustrated mounting means. The male connector M includes a synthetic resin male housing 10 and male terminal fittings 11. The male housing 10 has a wide narrow terminal holding portion 12 and a rectangular tubular receptacle 13 that projects forward from the peripheral edge of the terminal holding portion 12. Twenty terminal insertion holes 12*a* are arranged side-by-side at substantially even intervals along a width direction WD at each of upper and lower stages of the terminal holding portion 12. The terminal insertion holes 12*a* at the upper stage are displaced from those at the lower stage along the width direction WD. Male terminal fittings 11 are insertable from behind into the terminal insertion holes 12*a* so that a connecting portion 11*a* of each male terminal fitting 11 projects forward into the receptacle 13. A portion of each male terminal fitting 11 rearward from the terminal holding portion 12 is bent down substantially at a right angle, and a board connecting portion 11*b* of each male terminal fitting 11 is bent again substantially at a right angle to extend rearward. The board connecting portion 11*b* is electrically connectable with a conductor path (not shown) printed on the circuit board K by soldering, welding, press fitting, or the like.

An escaping groove 14 is formed in an intermediate portion of the upper wall of the receptacle 13 relative to the width direction WD. The escaping groove 14 has an open front end and is thinner than the opposite side portions of the upper wall. A fitting recess 15 is formed through the upper wall of the receptacle 13 and into the escaping groove 14. An engaging portion 16 is formed at the front of the upper wall before the fitting recess 15. The inner surface of the engaging portion 16 slopes up towards the front and the rear locking surface of the engaging portion 16 and extends substantially straight in the width direction WD. Four receiving recesses 17 are formed in each of the upper and lower surfaces of the inner periphery of the receptacle 13.

Figure 2:
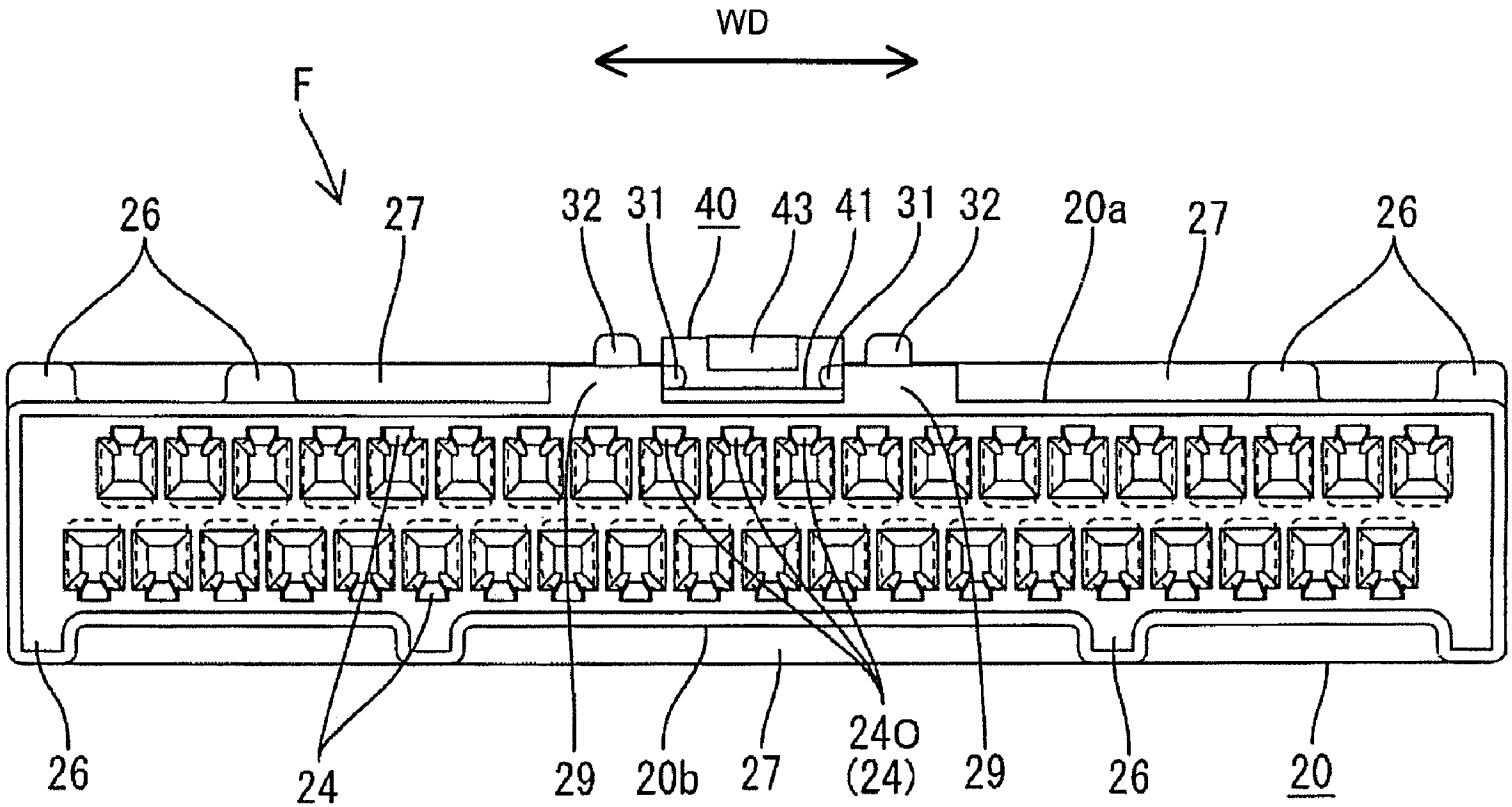
FIG. 2 is a front view of a female connector.

The female connector F has a synthetic resin female housing 20 and female terminal fittings 21, as shown in FIGS. 2 and 8. The female housing 20 is a wide narrow block and cavities 22 extend through the female housing 20 at positions corresponding to the terminal insertion holes 12*a* of the male connector M. More particularly, twenty cavities 22 are arranged substantially side by side substantially at even intervals along the width direction WD at each of upper and lower stages in the female housing 20. The cavities 22 at the upper stage are displaced from those at the lower stage along the width direction WD. The female terminal fittings 21 are insertable into the cavities 22 along an inserting direction ID. Each female terminal fitting 21 has a box-shaped main portion 21*a* that is substantially hollow along forward and backward directions. A barrel 21*b* is coupled behind the main portion 21*a* and is configured for crimped, bent or folded connection with an end of a wire W. A resilient contact 21*c* is in the main portion 21*a* and can be brought into contact with the connecting portion 11*a* of the male terminal fitting 11.

Figure 4:
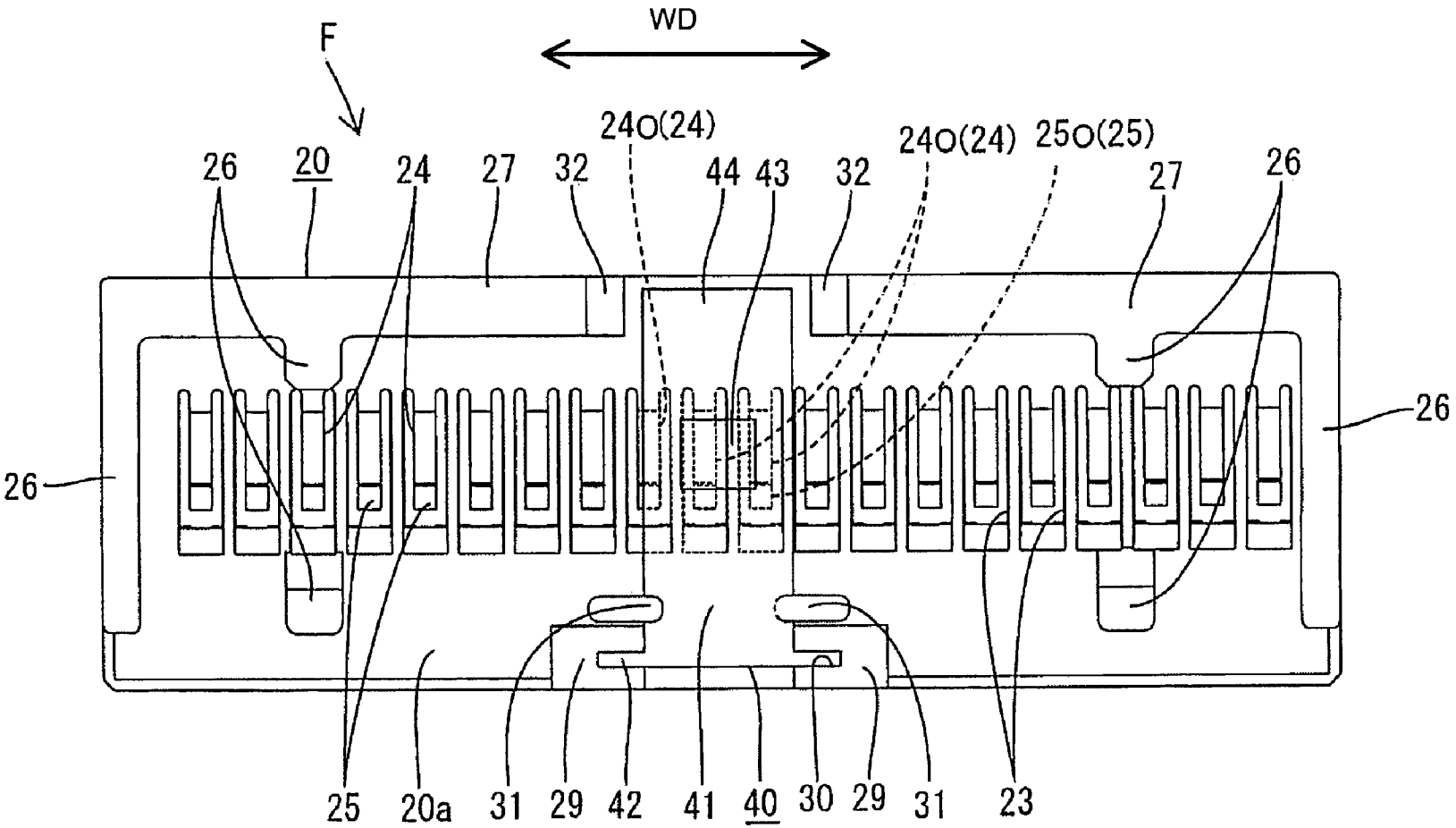
FIG. 4 is a plan view of the female connector.

Locks 24 are cantilevered from the upper walls of the cavities 22 at the upper stage and the bottom walls of the cavities 22 at the lower stage. The locks 24 are formed by U-shaped slits 23, as shown in FIGS. 4 and 8. The slits 23 are formed in upper and bottom surfaces 20*a*, 20*b* of the female housing 20 to communicate with the outside. Thus, the insides of the cavities 22 can be seen through the slits 23 from the outside and the locks 24 are exposed to the outside. Each lock 24 is resiliently deformable vertically in a direction intersecting the insertion direction ID and is engageable with a jaw 21*d* of the main portion 21*a* of the female terminal fitting 21 to retain the female terminal fitting 21 in the cavity 22. The lock 24 extends obliquely forward from the rear base end towards the front free end to project into the cavity 22. The outer surface of each lock 24 is substantially continuous with the upper surface 20*a* or the lower surface 20*b* of the female housing 20.

A detector 25 projects out from the outer surface of the front end of each lock 24. The outer surface of the detector 25 is substantially flush with the upper surface 20*a* or the lower surface 20*b* of the female housing 20 when the lock 24 is in an unbiased state. However, the detector 25 projects out from the upper surface 20*a* or the lower surface 20*b* of the female housing 20 when the lock 24 is deformed resiliently (see FIG. 6). Accordingly, the front end surfaces of the detectors 25 contact the front end surface of the receptacle 13, if an attempt is made to connect the housings 10, 20 with the locks 24 resiliently deformed, thereby hindering the connecting operation. In other words, deformation spaces 33 for the respective locks 24 are defined outside the upper and lower surfaces 20*a*, 20*b* of the female housing 20 and are shared as a connection space with the mating male connector M.

As shown in FIGS. 2, 4 and 8, elongated projections 26 are provided on the upper and lower surfaces 20*a*, 20*b* of the female housing 20 to guide the connection of the housings 10, 20. More specifically, two elongated projections 26 are provided at substantially opposite widthwise sides and two elongated projections 26 are provided at intermediate positions towards the widthwise center of each of the upper and lower surfaces 20*a*, 20*b* of the female housing 20. Thus, a total of eight elongated projections 26 are provided. The elongated projections 26 at the widthwise sides are continuous from the rear end of the female housing 20. However, the elongated projections 26 nearer the widthwise center have intermediate portions removed and are divided into front and rear sections (see FIG. 4) to expose the locks 24 at the upper and lower surfaces 20*a*, 20*b* of the female housing 20. The upper and lower elongated projections 26 nearer the center are displaced from each other along width direction WD. The front ends of the lower elongated projections 26 substantially align with the front end of the female housing 20. However, the front ends of the upper elongated projections 26 have undercut front surfaces that are retracted from the front end of the female housing 20.

Figure 3:
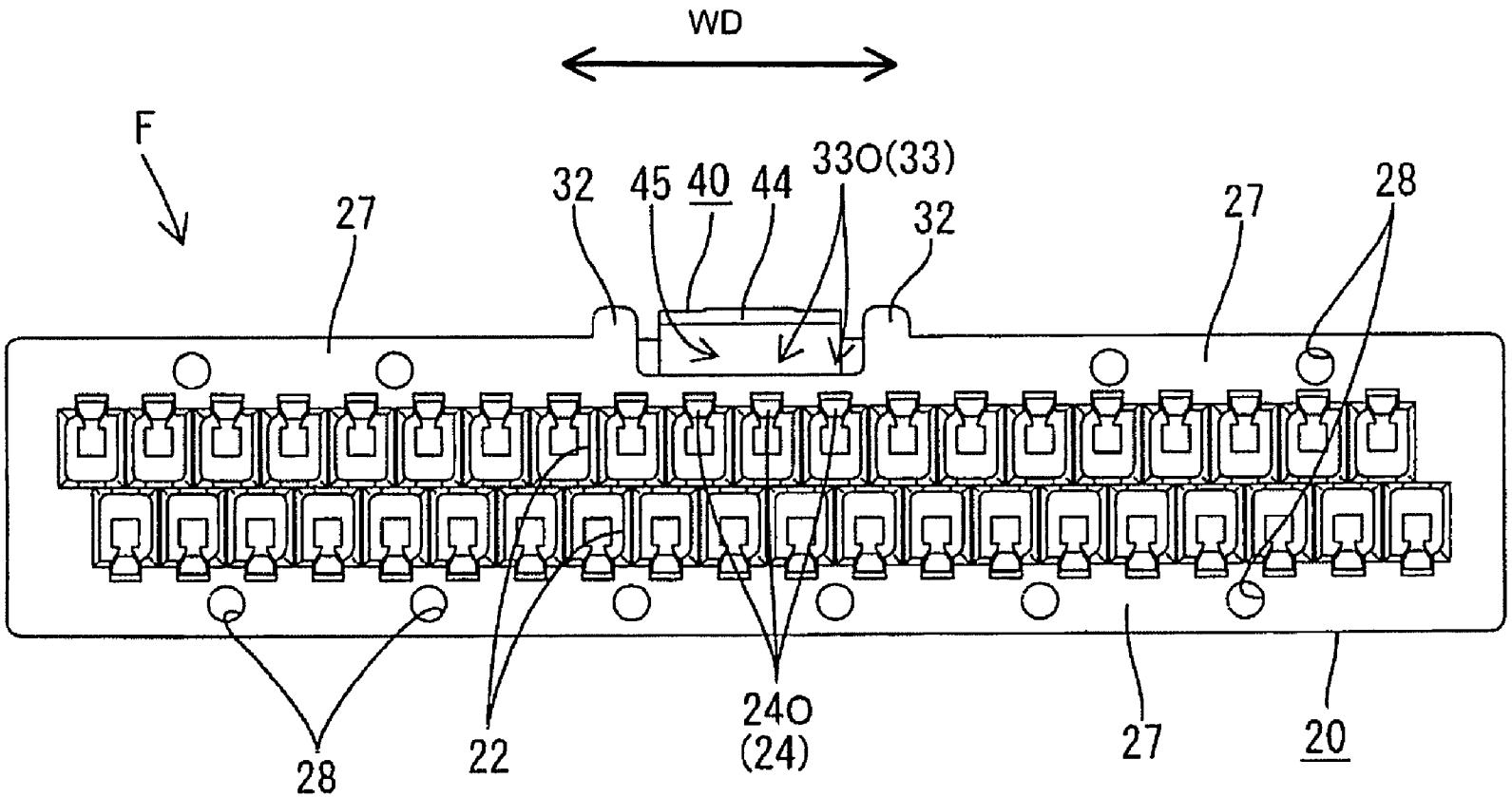
FIG. 3 is a rear view of the female connector.

Two ribs 27 extend along the width direction WD at the rear ends of the upper and lower surfaces 20*a*, 20*b* of the female housing 20, as shown in FIGS. 2 to 4. The ribs 27 extend over substantially the entire width of the female housing 20 and couple the elongated projections 26 at the opposite ends. Thus, the ribs 27 contribute to the strength of the female housing 20. A widthwise middle of the upper rib 27, is recessed sufficiently to let the lock arm 40 escape, as shown in FIG. 2. The ribs 27 have substantially the same height as the elongated projections 26 and allow an operator to place his fingers thereon for connecting and separating the female housing 20 (see FIG. 13). Marks 28 are on the rear surfaces of the elongated projections 26 and the ribs 27 (see FIG. 3) for letting the operator visually confirm the positions of the cavities 22. The intervals and shape of the marks 28 can be changed from those shown.

Figure 7:
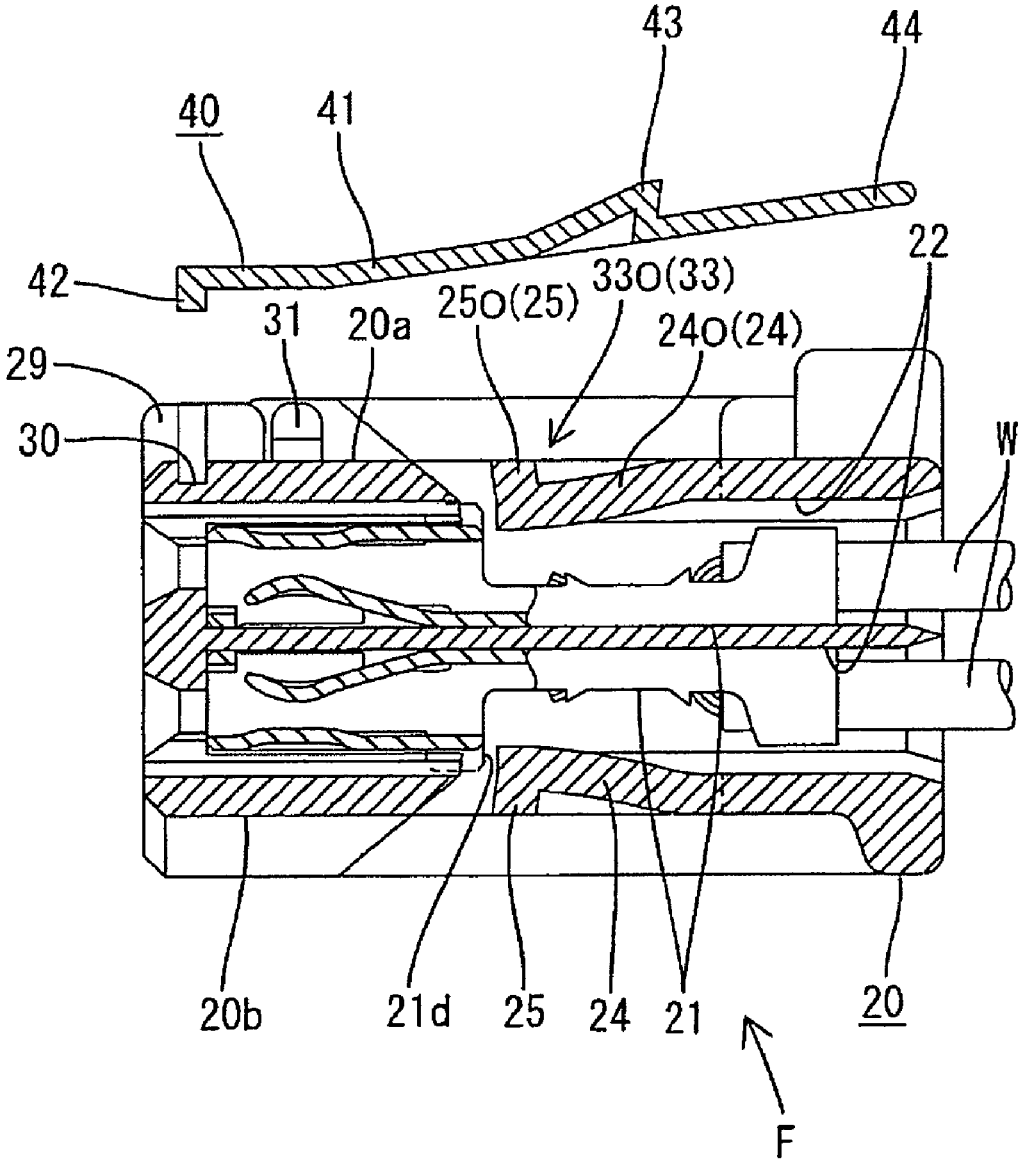
FIG. 7 is a side view in section showing a state where the female terminal fittings are at their proper depth before a lock arm is mounted.
Figure 8:
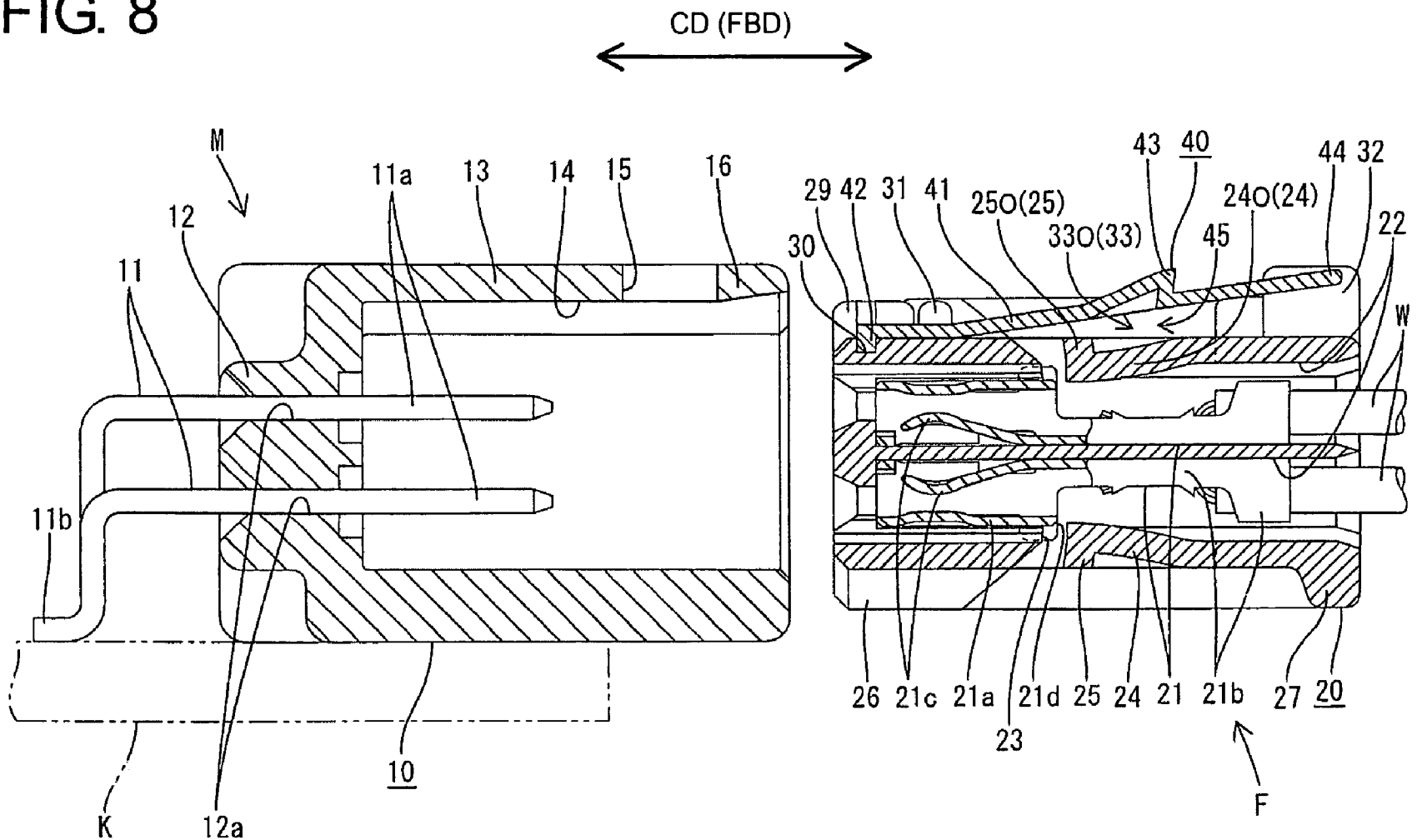
FIG. 8 is a side view in section showing a state where the lock arm is mounted before the two connectors are connected.

As shown in FIGS. 4 and 7, the lock arm 40 is obtained by press-working a metal plate (e.g. stainless steel). Thus, the lock arm 40 is formed separate from the female housing 20, and is mounted onto the upper surface 20*a* of the female housing 20. The lock arm 40 has an arm portion 41 that extends along forward and backward directions FBD, and a press-in portion 42 that projects down towards the female housing 20 from the front end of the arm portion 41. The press-in portion 42 is pressed into engagement with the female housing 20. A front section of the arm portion 41 is substantially horizontal along forward and backward directions FBD, and a rear section of the arm portion 41 slopes up and away from the female housing 20 towards the back. An intermediate part of the sloped section of the arm portion 41 is embossed to project up away from the female housing 20 to form a lock 43. The front surface of the lock 43 slopes up and away from the female housing 20 and towards the back with a slightly steeper slope than the sloped section of the arm portion 41. However, the rear surface of the lock 43 is at an angle, preferably in a range of about 75° to about 105°, with respect to the connecting direction CD. The rear surface of the lock 43 overhangs to slope down and in towards the female housing 20 and towards the front. The press-in portion 42 is wider than the arm portion 41.

Two lock-arm holders 29 are provided at the front end of a widthwise middle part of the upper surface 20*a* of the female housing 20 for holding the lock arm 40. The lock-arm holders 29 are spaced apart transversely by about the width of the arm portion 41, as shown in FIG. 4, and project up and out from the upper surface 20*a* of the female housing 20 to a height substantially equal to the heights of the elongated projections 26 and the ribs 27. The lock-arm holders 29 have open-ended press-in grooves 30 that receive the press-in portion 41. Two retainers 31 are provided immediately behind the lock-arm holders 29 for engaging the upper surface of the arm portion 41 to retain the lock arm 40. The lock-arm holders 29 and the retainers 31 enter the escaping groove 14 of the receptacle 13 together with the arm portion 41 of the lock arm 40 when the female housing 20 is connected with the male housing 10.

Figure 9:
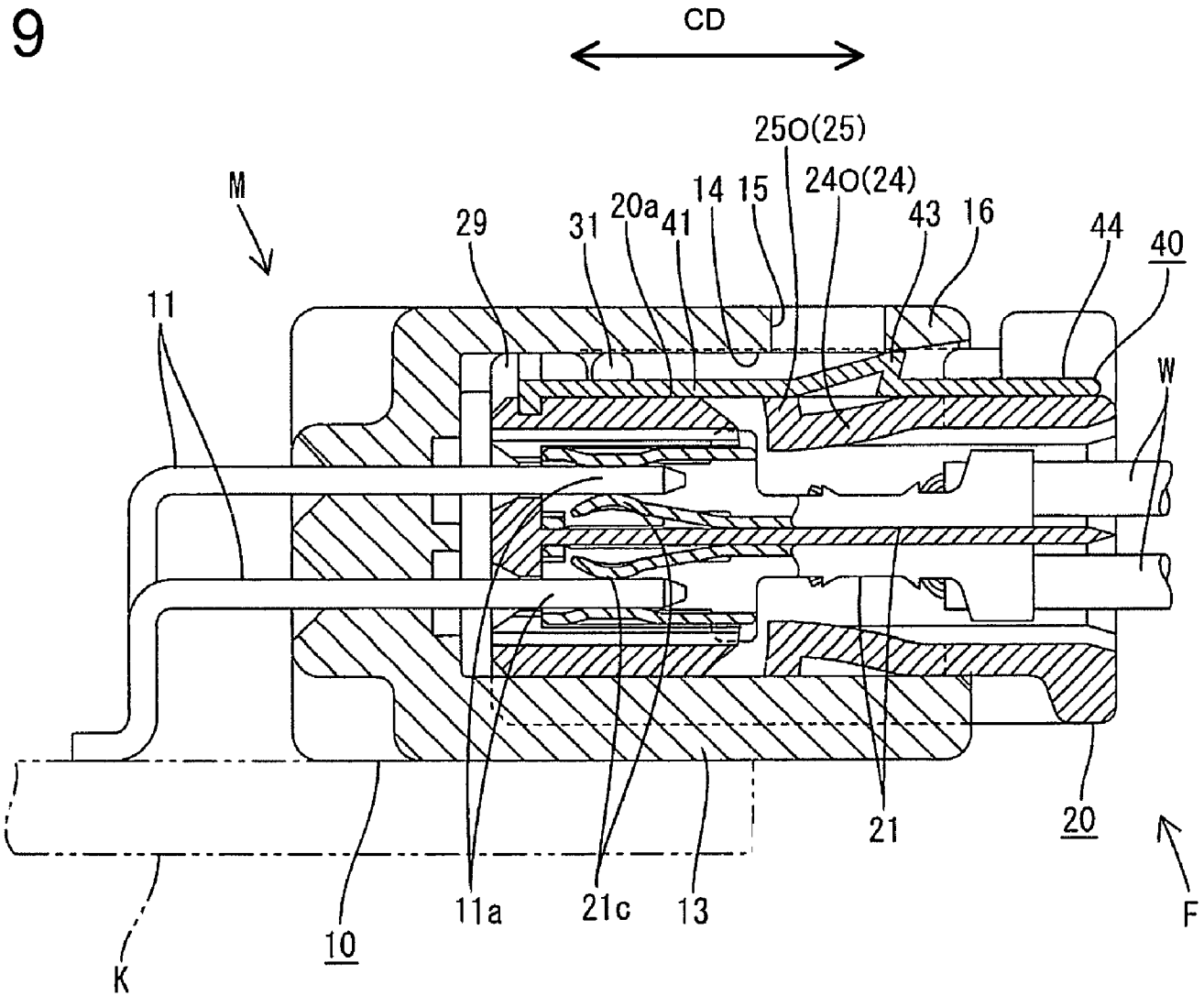
FIG. 9 is a side section al view showing an intermediate stage of the connection of the two connectors.

The press-in portion 42 is pressed in the press-in grooves 30 to mount the lock arm 40 on the female housing 20. The lock arm 40 then is resiliently deformable substantially vertically in a direction intersecting the connecting direction CD. Rear positions of engaging parts of the arm portion 41 with the retainers 31 are the support for this deformation, as shown in FIG. 8. Thus, the arm portion 41 retracts into a deformation space 45 between the arm portion 41 and the upper surface 20*a* of the female housing 20, as shown in FIG. 9. The arm portion 41 of the mounted lock arm 40 overlaps three cavities 22 at the widthwise middle of the upper cavities 22, as shown in FIG. 4, and faces the locks 24O in these cavities 22. The suffix O denotes portions of the female housing 20 that are overlapped by the arm portion 41. The lock arm 40 can be retracted into the deformation spaces 33O for these three locks 24O during the resilient deformation of the lock arm 40. Thus, the deformation spaces 33O for the locks 24O are shared as the deformation space 45 for the lock arm 40. On the other hand, the detectors 25O reach an arrangement space of the arm portion 41 beyond the deformation space 45 for the lock arm 40 during the resilient deformation of the locks 24O that face the lock arm 40 (see FIG. 6).

The front end of the mounted lock arm 40 is supported on the female housing 20 by the press-in portion 42 at the front end fixed to the female housing 20. An operable portion 44 is formed at the free rear end of the lock arm 40. A downward pressing force on the operable portion 44 resiliently deforms the arm portion 41 down towards the female housing 20 and in unlocking direction. Two protecting portions 32 are provided at the inner ends of the upper rib 27 of the female housing 20 and project up to at least the same height as the upper end of the operable portion 44, as shown in FIGS. 3 and 4. The protecting portions 32 prevent an unillustrated external wire or the like from entering below the operable portion 44 from behind. As a result, the lock arm 40 cannot be turned forward.

Figure 5:
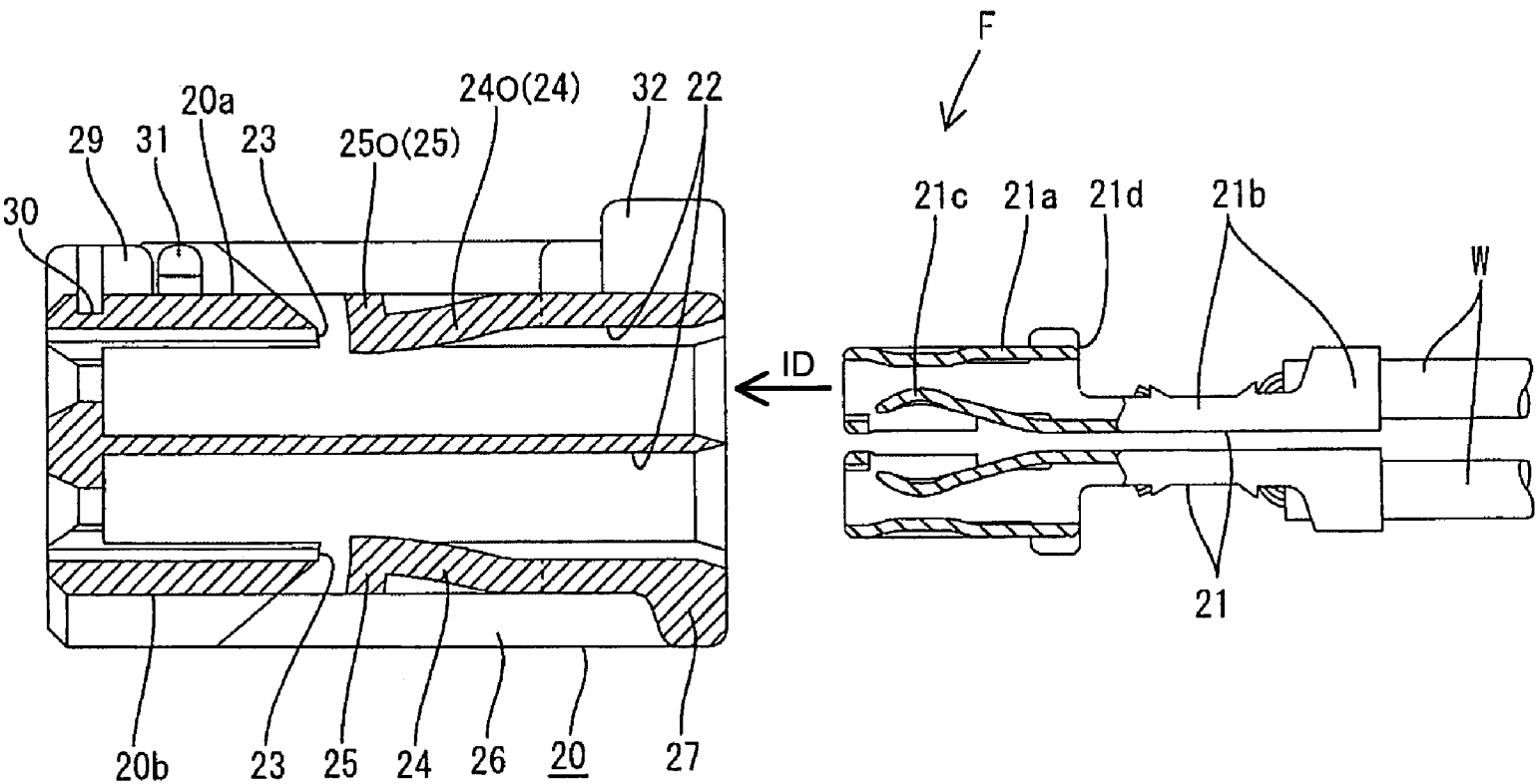
FIG. 5 is a side view in section showing a state before female terminal fittings are inserted into the female housing.
Figure 6:
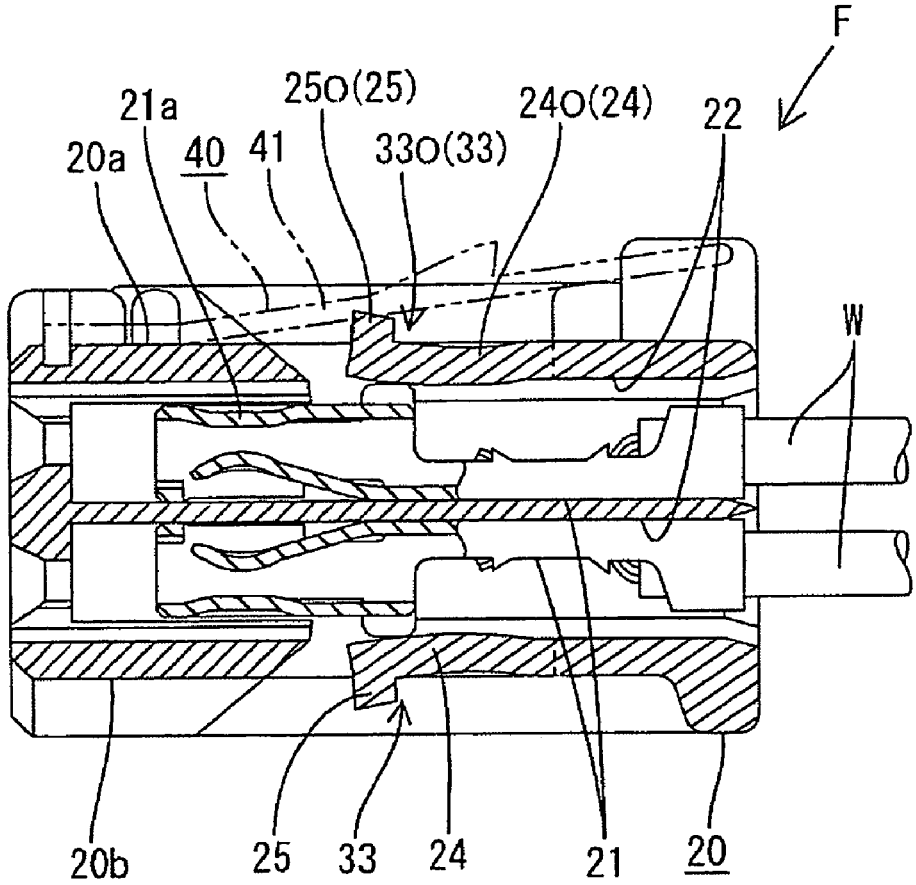
FIG. 6 is a side view in section showing an intermediate stage of the insertion of the female terminal fittings into the female housing.

The male connector M is assembled and mounted on the circuit board K. The female connector F also is assembled. More particularly, the female terminal fittings 21 are crimped to ends of the wires W and are inserted into the respective cavities 22 along the inserting direction ID, as shown in FIG. 5. The main portions 21*a* press the locks 24 at an intermediate stage of the insertion and temporarily deform the locks 24 in a direction intersecting the inserting direction ID. Thus, the detectors 25 project out from the upper or lower surface 20*a*, 20*b* of the female housing 20. The locks 24 are restored resiliently when the female terminal fittings 21 reach a proper depth, and the restored locks 24 engage the jaws 21*d* of the main portions 21*a*, as shown in FIG. 7, to retain the female terminal fittings 21. Insufficient insertion of a female terminal fitting 21 can be detected by visually conforming the projecting detector 25 (25O) or the female terminal fittings 21 in the cavity 22 through the slit 23.

The lock arm 40 then is mounted on the female housing 20. More particularly, the front end of the lock arm 40 is pressed from a state shown in FIG. 7, to press the press-in portion 42 into the press-in grooves 30. The arm portion 41 moves beyond the retaining portions 31 so that the retaining portions 31 engage the upper surface of the arm portion 41, as shown in FIG. 8, to hold the lock arm 40 in its press-in state. An attempt could be made to mount the lock arm 40 with a female terminal fitting 21 partly inserted. However, the lock arm 40 will interfere with the detectors 25O of the locks 24O because the locks 24O facing the lock arm 40 project into the arrangement space for the lock arm 40 and hinder the mounting operation (see FIG. 6). In this way, insufficient insertion of a female terminal fitting 21 can be detected. The female terminal fittings 21 may be inserted after the lock arm 40 is mounted. In such a case, the arm portion 41 may temporarily be turned forward and then the female terminal fittings 21 may be inserted. Then, the locks 24O and the like can easily be confirmed visually from the outside even for the e.g. three middle cavities 22 overlapping the lock arm 40. After the female terminal fittings 21 are inserted, the lock arm 40 may be returned to its initial posture.

The female connector F then is connected with the male connector M along the connecting direction CD. An attempt could be made to connect the female housing 20 with the male housing 10 in an incorrect orientation, e.g. upside down. However, the front ends of the elongated projections 26 will contact the front surface of the receptacle 13 to prevent an erroneous connection. An attempt also could be made to connect the housings 10, 20 while overlooking the detection of insufficiently inserted female terminal fittings 21. However, the front ends of the detectors 25 of the locks 24 project from the upper and/or lower surfaces 20*a*, 20*b* of the female housing 20 and contact the front end surface of the receptacle 13 to hinder connection. As a result, insufficient insertion of the female terminal fittings 21 is detected (see FIG. 6).

Figure 10:
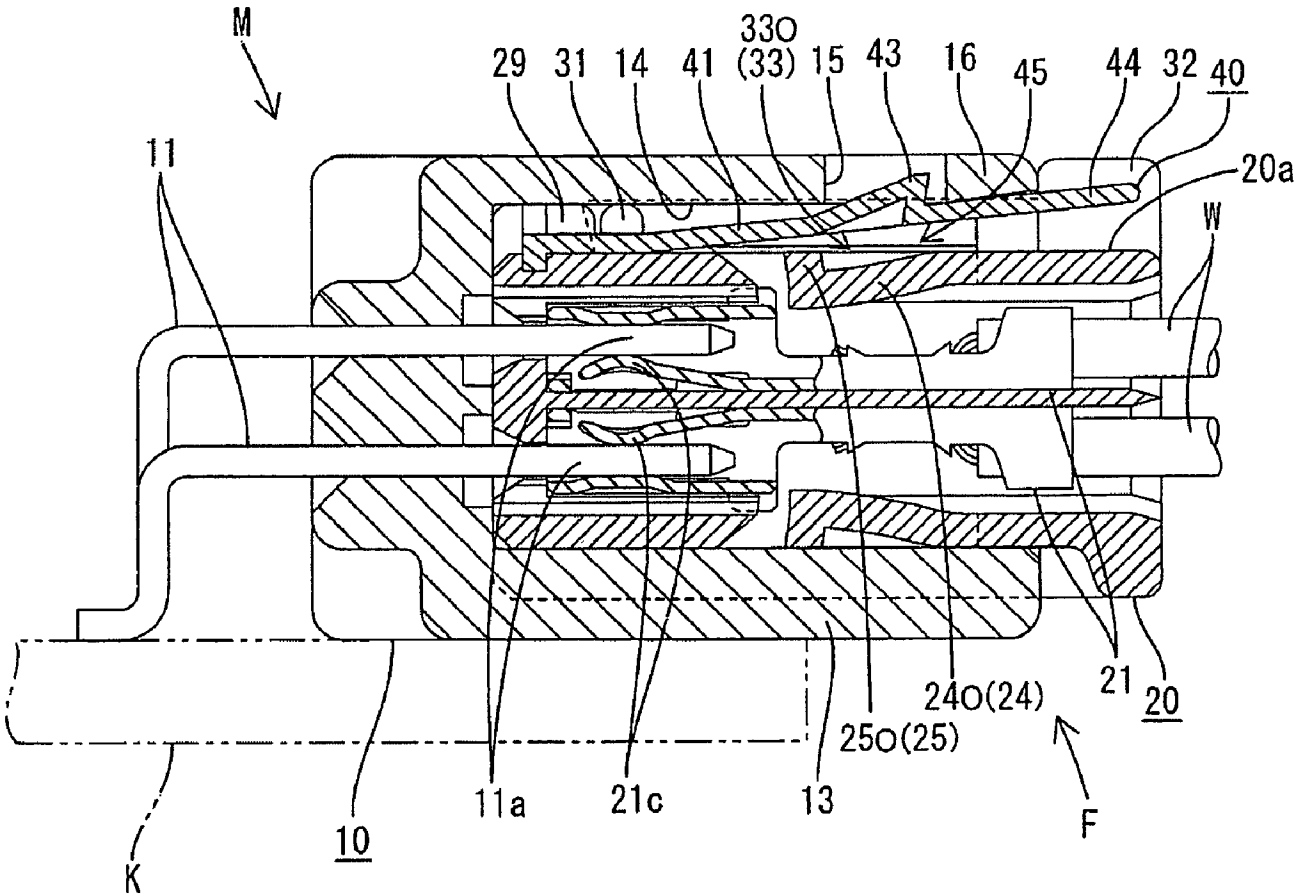
FIG. 10 is a side view in section showing a state where the two connectors are properly connected with each other.

The elongated projections 26 of the properly oriented female housing 20 enter the corresponding receiving recesses 17, as shown in FIG. 8, to guide the female housing 20 smoothly into the receptacle 13. Further, the arm portion 41 of the lock arm 40, the lock-arm holders 29 and the retainers 31 escape into the escaping groove 14 of the receptacle 13. The slanted front surface of the lock 43 and the slanted front surface of the engaging portion 16 slide in contact with each other when the female housing 20 is connected to a specified depth. Thus, the lock arm 40 deforms about positions where the retainers 31 engage the arm portion 41, as shown in FIG. 9. As a result, the arm portion 41 retracts into the deformation space 45 at the female housing 20 side. The maximally deformed arm portion 41 is substantially horizontal and substantially parallel to the forward and backward directions FBD over substantially the entire length. Additionally, the lower surface of the arm portion 41 reaches the upper surface 20*a* of the female housing 20. The lock 43 reaches the fitting recess 15 when the female housing 20 is connected to a proper depth and the lock arm 40 is restored resiliently to engage the rear surface of the lock 43 with the rear surface of the engaging portion 16, as shown in FIG. 10. In this way, the connectors F, M are connected with each other. At this time, the resilient contact pieces 21*c* of the female terminal fittings 21 are held properly in resilient contact with the connector connecting portions 11*a* of the male terminal fittings 11.

Figure 11:
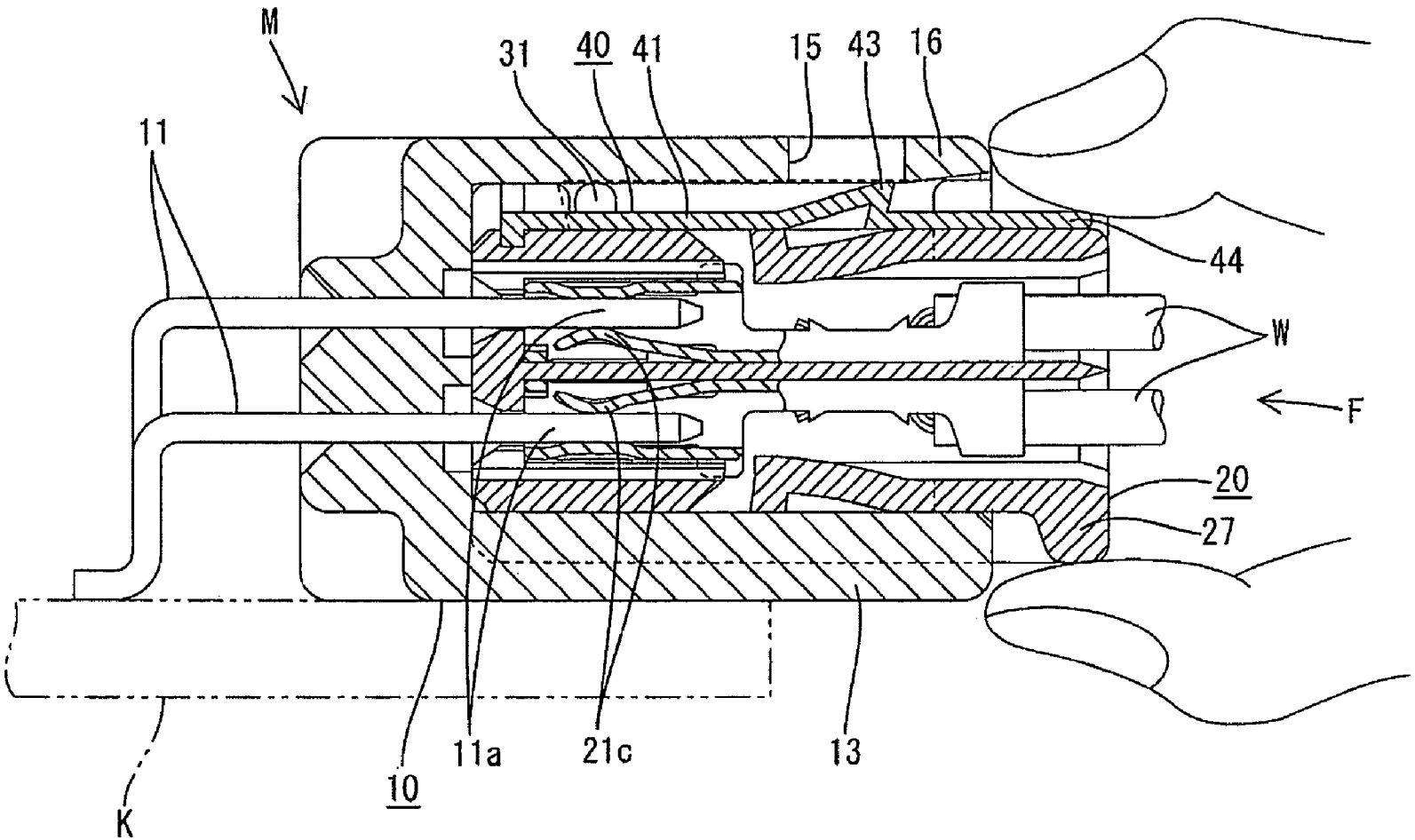
FIG. 11 is a side view partly in section showing a state where an operable portion is pressed at the time of separating the two connectors.

The female connector F may have to be separated from the male connector M for maintenance or other reason. In such cases, the operable portion 44 is pressed from above to deform the lock arm 40 resiliently towards the female housing 20. As a result, the arm portion 41 and the lock 43 are displaced away from the engaging portion 16 and the fitting recess 15, as shown in FIG. 11, and an engaging area of the lock 43 with the engaging portion 16 gradually decreases. The female housing 20 then is pulled back with the operable portion 44 kept pressed until the lock 43 is disengaged completely from the engaging portion 16. The female connector F then can be separated from the male connector M. During this separating operation, the female connector F can be pulled easily by placing the fingers on the ribs 27 on the upper and lower surfaces 20*a*, 20*b* of the female housing 20.

As described above, the metallic lock arm 40 is held pressingly on the female housing 20. Thus, as compared to a prior art connector in which a housing is molded unitarily with a lock arm, the projecting height of the lock arm 40 from the female housing 20 is reduced, and the female connector F is smaller along the height direction. Further, the separate lock arm 40 can be exchanged if it is broken.

Furthermore, the lock arm 40 preferably is mounted the female housing 20 after the female terminal fittings 21 are inserted into the female housing 20. Thus, the lock arm 40 does not hinder the visual confirmation of the locks 24O that will face the lock arm 40.

The lock arm 40 faces the locks 24O and can be retracted into the deformation spaces 33O for the locks 24O. Accordingly, the deformation spaces 33O for the locks 24O are shared as the deformation space 45 for the lock arm 40 during the resilient deformation of the lock arm 40. Thus, the female connector F is miniaturized as compared to connectors with separate deformation spaces for locks and a lock arm are separately.

In addition, the lock arm 40 has the press-in portion 42 projecting down and the female housing 20 has the press-in grooves 30 with open upper ends. Thus, the press-in portion 42 can be pressed into the press-in grooves 30 from above, and the lock arm 40 can be mounted easily.

A second embodiment of the invention is described with reference to FIGS. 12 to 15. This second embodiment shows a modified mounting construction for the lock arm 40. Elements of the second embodiment that are the same as or similar to the first embodiment are not described again, but merely are identified by the same reference numerals.

Figure 12:
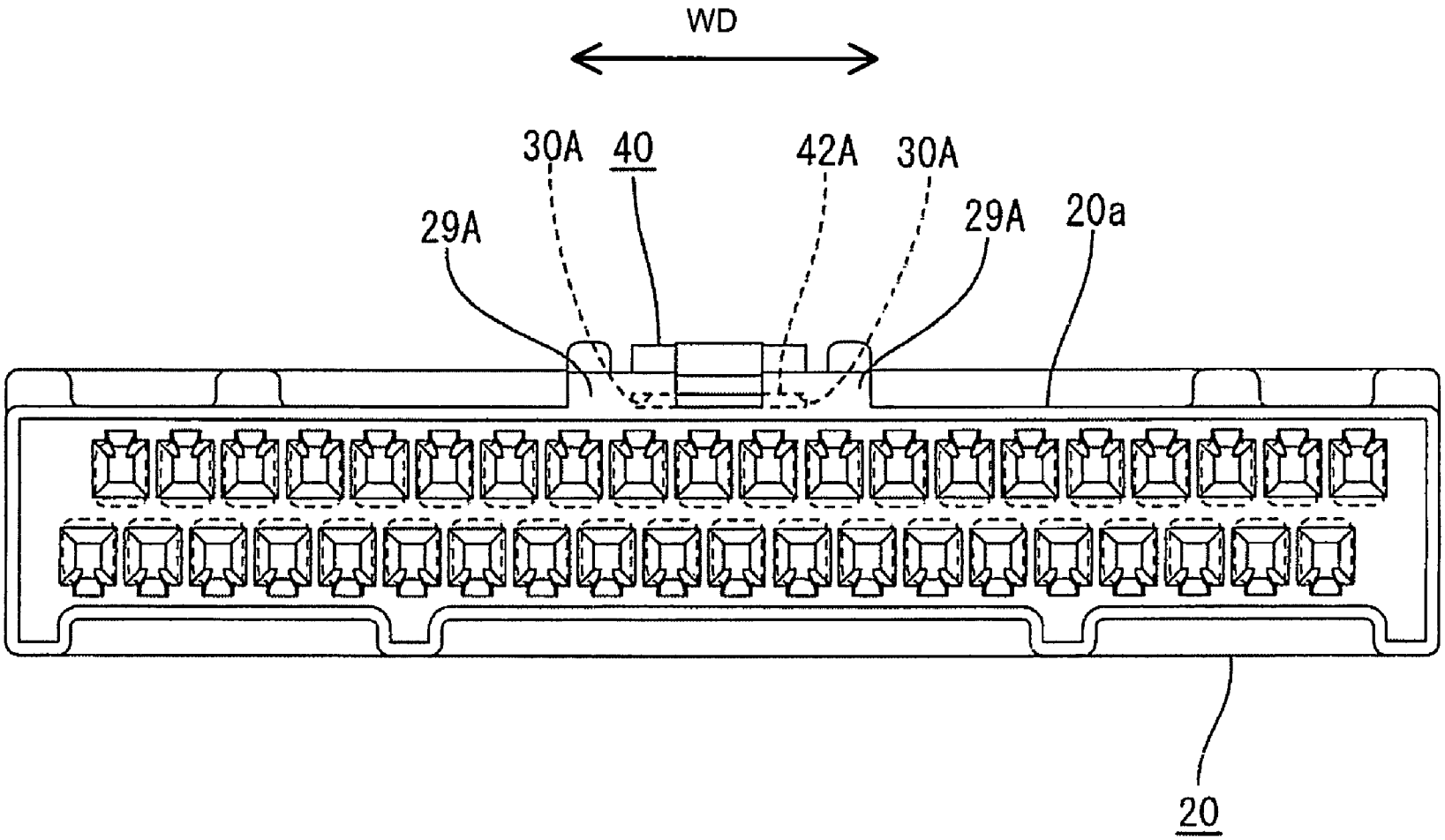
FIG. 12 is a front view of a female connector according to a second embodiment of the invention.
Figure 13:
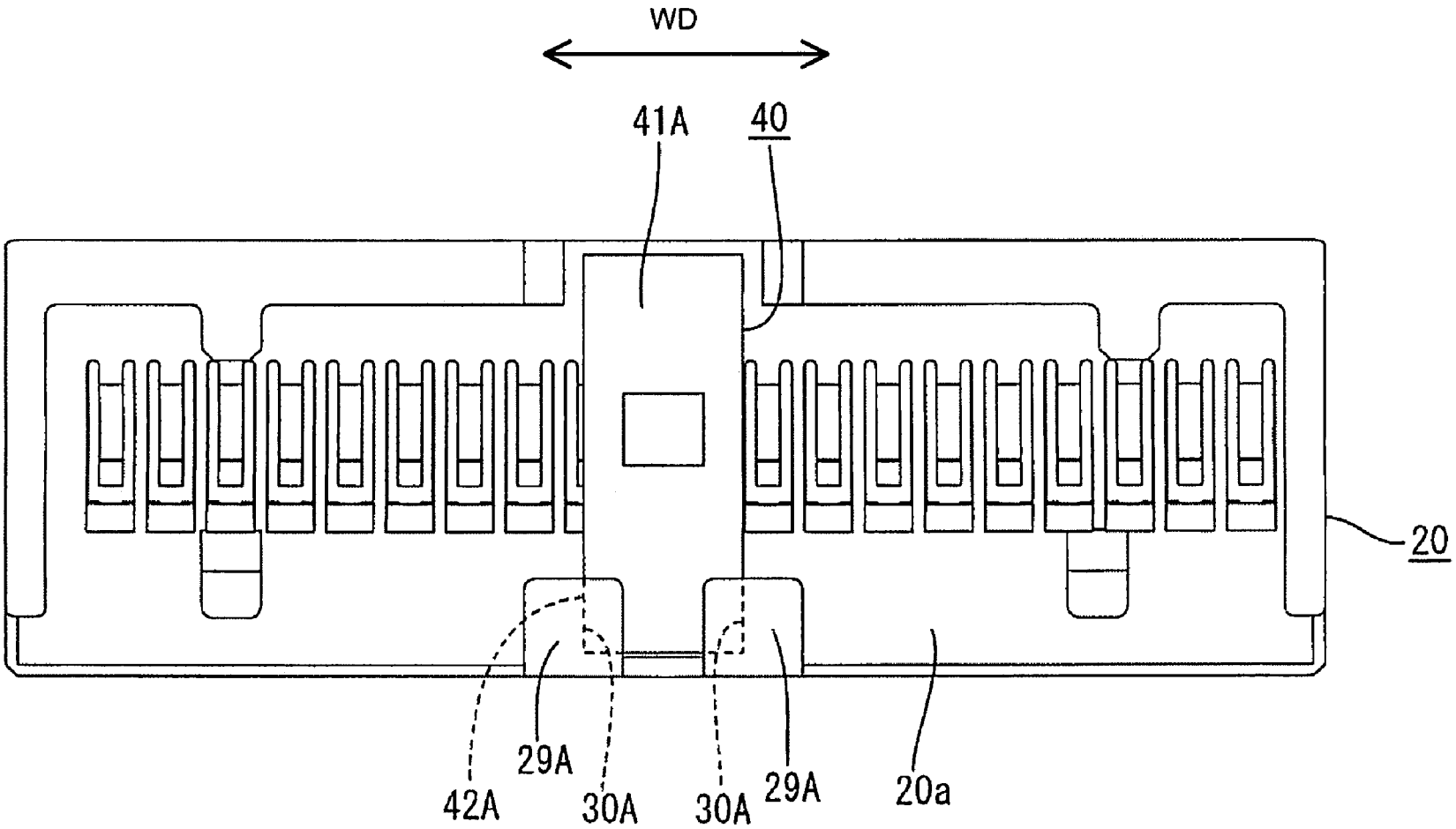
FIG. 13 is a plan view of the female connector.
Figure 14:
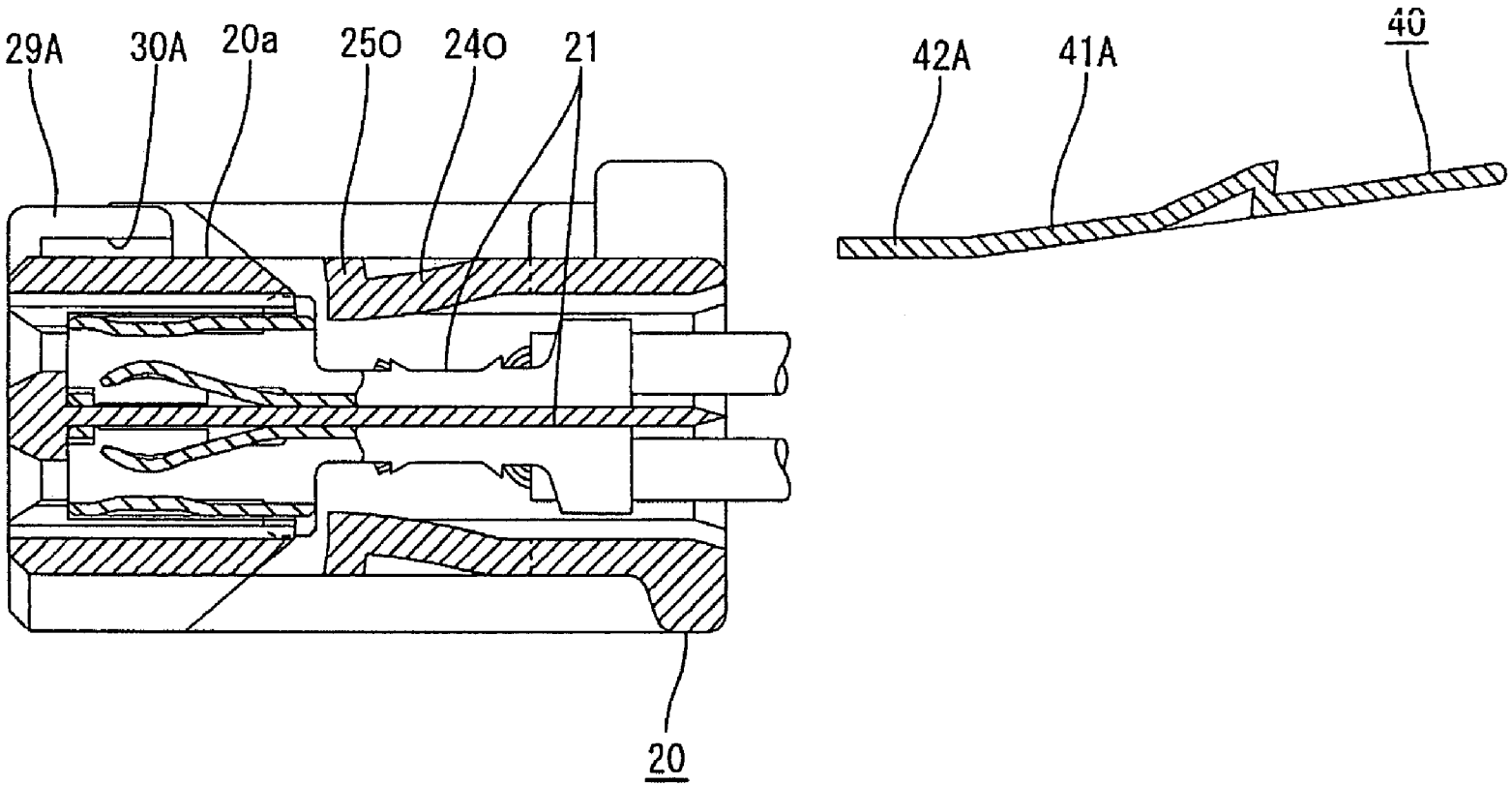
FIG. 14 is a side view in section showing a state before a lock arm is mounted.
Figure 15:
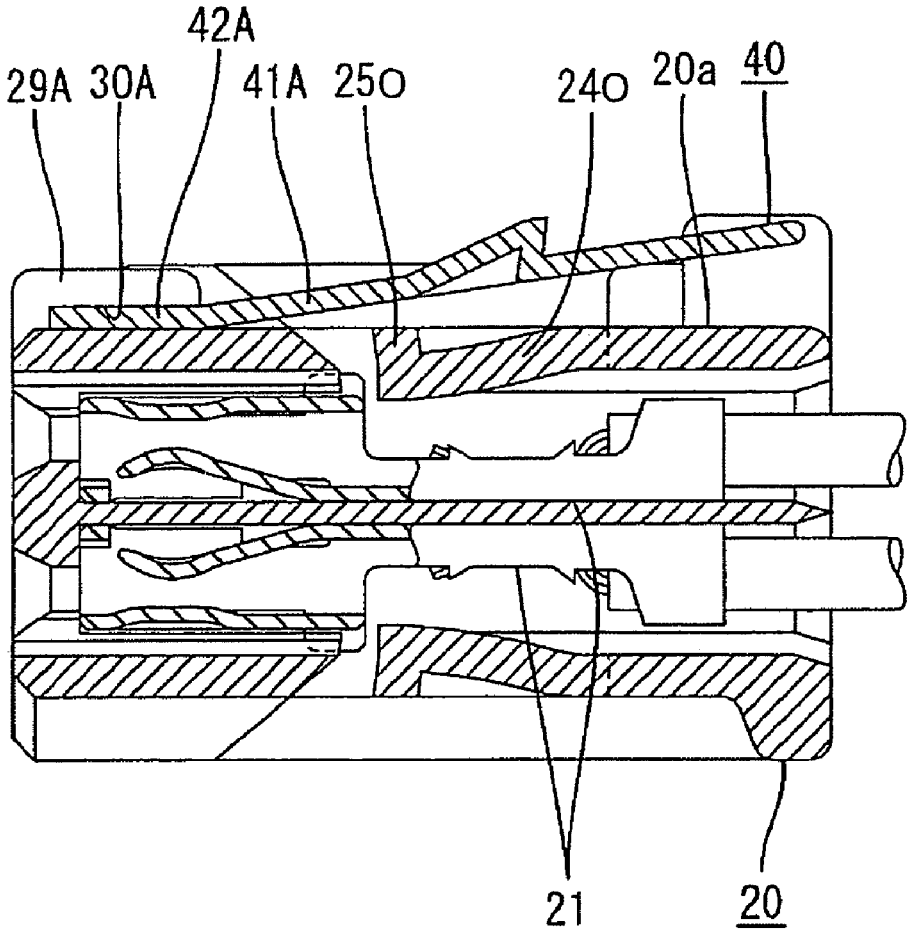
FIG. 15 is a side view in section showing a state where the lock arm is mounted.

As shown in FIGS. 12 to 14, a female housing 20 has an upper surface 29A and two spaced-apart lock-arm holders 29A project from the upper surface 20*a*. Press-in grooves 30A are formed in the rear surfaces of the lock-arm holders 29A and have open rear ends. The lock arm 40 has an arm portion 41A, and a substantially horizontal press-in portion 42A extends substantially parallel with the forward and backward directions FBD at the front end of the arm portion 41A. The lock arm 40 can be slid forward in contact with the upper surface 20*a* of the female housing 20 from a state shown in FIG. 14 to press the press-in portion 42A into the press-in grooves 30A from behind. Detectors 25O of the locks 24O will project into the mounting path for the lock arm 40 if the corresponding female terminal fitting 21 is inserted insufficiently. Thus, the press-in portion 42A will interfere with the detector 25O and hinder the mounting operation. As a result, the insufficient insertion of the female terminal fittings 21 can be detected. The lock arm 40 is held pressingly on the female housing 20 when the press-in portion 42A is pressed to a proper depth in the press-in grooves 30A, as shown in FIG. 15. In this state, the lock arm 40 is resiliently deformable up and down towards and away from the female housing 20 about a position on the arm portion 41A at the rear ends of the lock-arm holders 29A. The retainers 31 of the first embodiment are not shown in the second embodiment, but may be provided.

A third embodiment of the invention is described with reference to FIGS. 16 to 24. In this embodiment, a metallic member 140 is formed integrally with a lock arm 143 and is mounted on a male connector M that is connectable along a connecting direction CD with a mating female connector F. In the following description, sides of the connectors F, M to be connected with each other are referred to as the front side, and reference is made to all of the FIGS. 16 to 24 except FIGS. 17 and 19 concerning the vertical direction.

Figure 16:
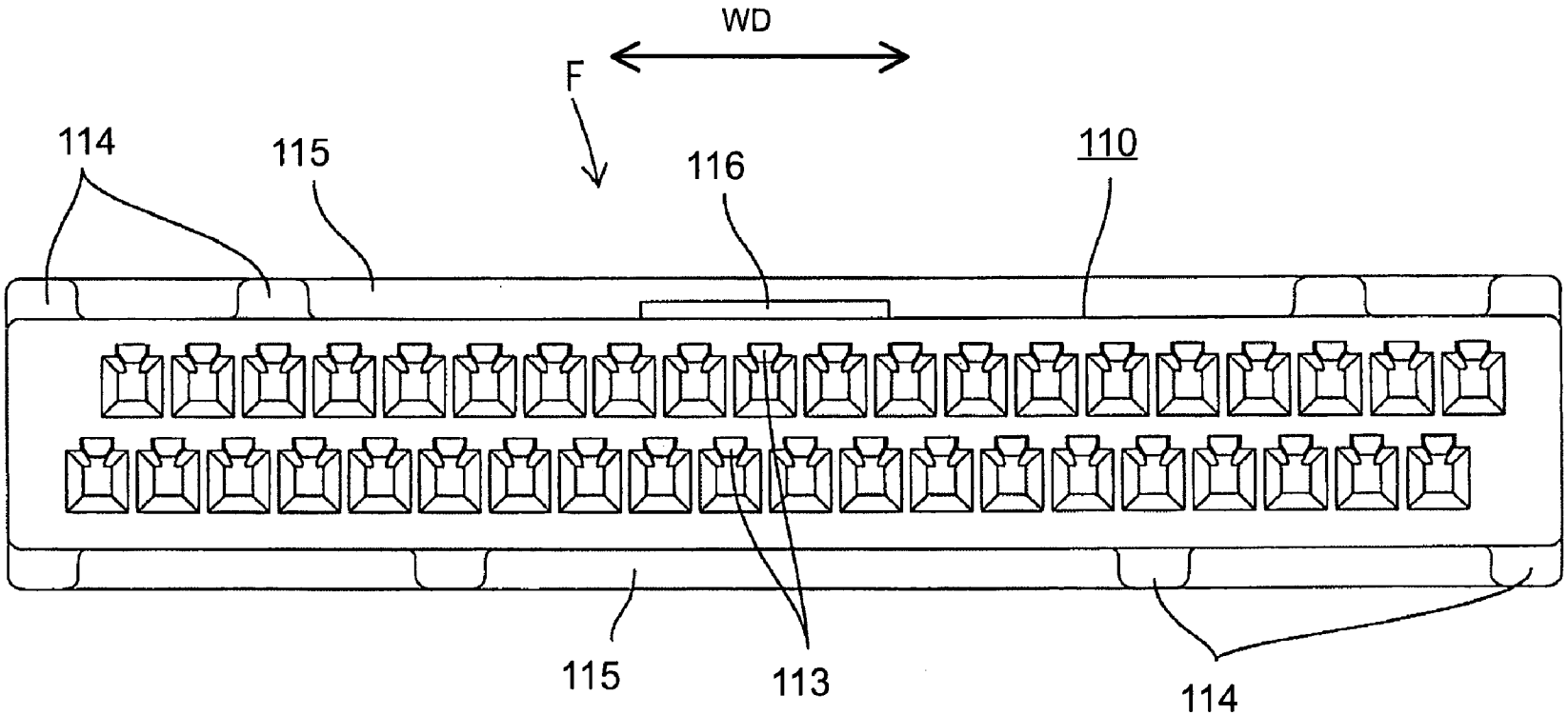
FIG. 16 is a front view of a female connector according to a third embodiment of the invention.
Figure 21:
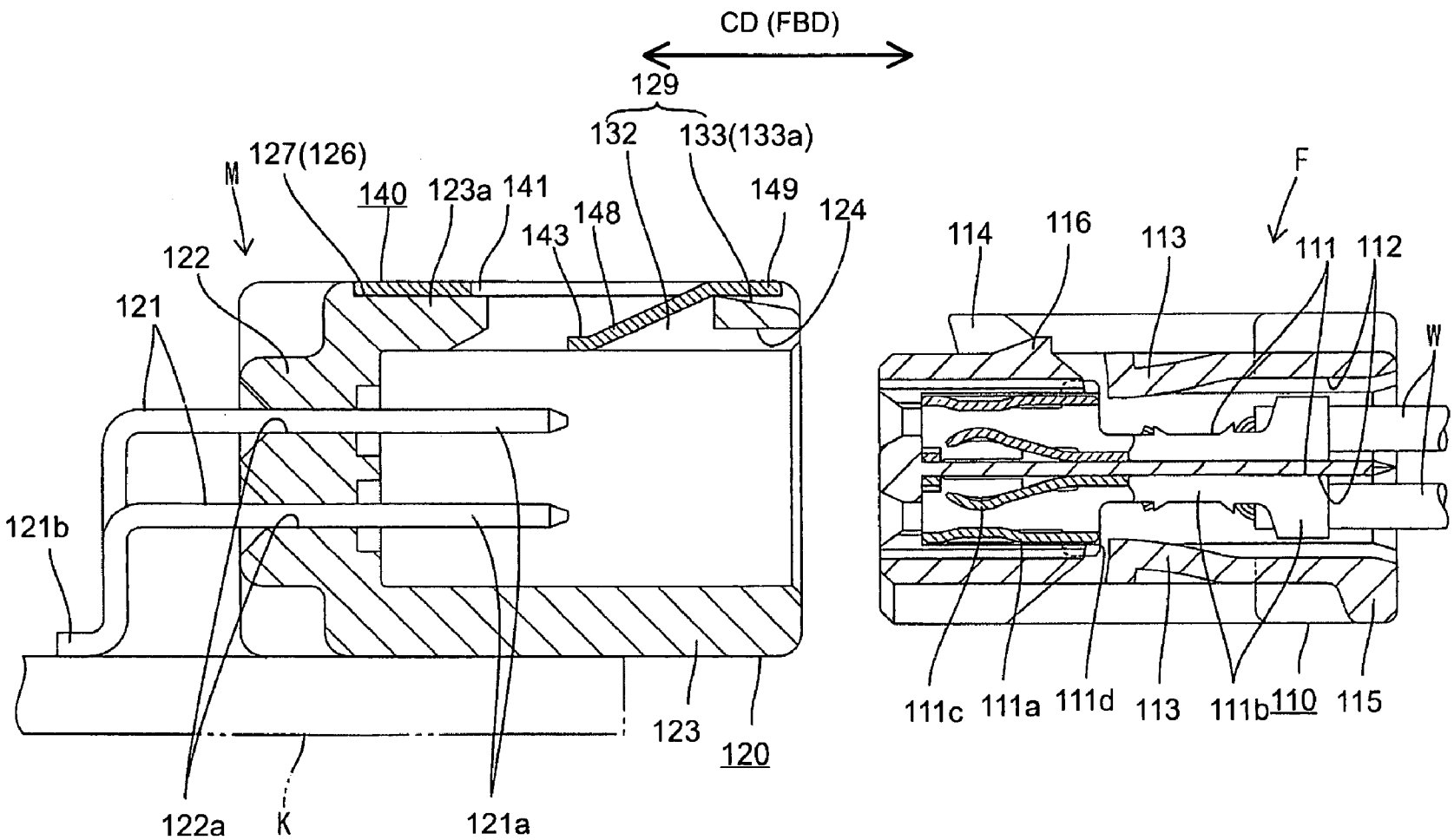
FIG. 21 is a side view in section showing a state before the two connectors are connected.

As shown in FIGS. 16 and 21, the female connector F has a female housing 110 made e.g. of a synthetic resin and defining a block that is narrow and wide along a width direction WD. Forty female terminal fittings 111 are accommodated from behind in cavities 112 in the female housing 110. More particularly, the female housing 110 has twenty cavities 112 arranged side by side at even intervals along a width direction WD at each of upper and lower stages. The upper stage cavities 112 are displaced from the lower stage cavities 112 along the width direction WD. Each female terminal fitting 111 has a box-shaped main portion 111*a* that is hollow along forward and backward directions FBD. A barrel 111*b* is formed behind the main portion 111*a* and is configured for crimped, bent or folded connection with an end of a wire W. A resilient contact piece 111*c* is provided in the main portion 111*a*.

Locks 113 are formed by slits in the upper and lower walls of the female housing 110 so that the locks 113 cantilever forward from the upper walls of the upper stage cavities 112 and from the lower walls of the lower stage cavities 112. Each lock 113 is resiliently deformable vertically and is engageable with a jaw 111*d* of the main portion 11*a* of the female terminal fitting 111 to retain the female terminal fitting 111 in the cavity 112. The lock 113 extends obliquely into the cavity 112. The outer surface of each lock 113 is substantially continuous with the upper or lower surface of the female housing 110 when the lock is unbiased. However, the resiliently deformed locks 113 project out from the upper or lower surface of the female housing 110. Thus, the deformed locks 113 interfere with the front end surface of the receptacle 123 if an attempt is made to connect the two housings 110, 120 in this state.

Figure 17:
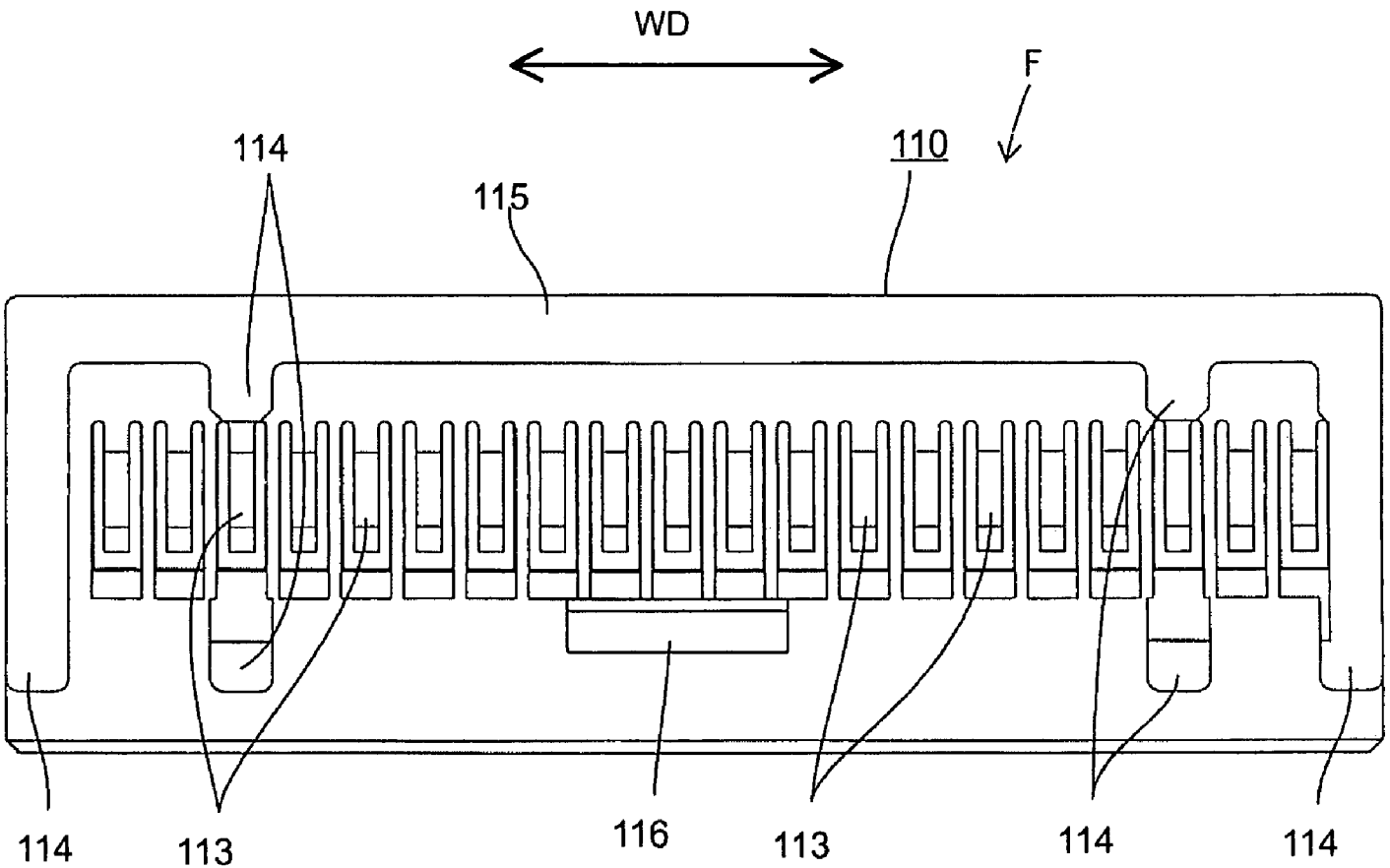
FIG. 17 is a plan view of the female connector.

Four elongated projections 114 are provided on each of the upper and lower surfaces of the female housing 110, as shown in FIGS. 16 and 17, to guide the connection of the housings 110, 120 along the connecting direction CD. More specifically, two elongated projections 114 are provided at substantially opposite widthwise sides and two elongated projections 114 are provided at more central positions towards the widthwise center of each of the upper and lower surfaces of the female housing 110. The elongated projections 114 extend forward from the rear end of the female housing 110. However, the elongated projections 114 towards the widthwise center have intermediate portions removed to the expose locks 113 and hence to divide the more central elongated projections 114 into front and rear sections (see FIG. 17). The more central upper elongated projections 114 are displaced along the width direction WD from the more central lower elongated projections 114. The front ends of the lower elongated projections 114 substantially align with the front end of the female housing 110. However, the front ends of the upper elongated projections 114 are retracted from the front end of the female housing 110 and are undercut to slope up towards the front. Two ribs 115 extend along the width direction WD at the rear ends of the upper and lower surfaces of the female housing 110. The ribs 115 are formed over substantially the entire width of the female housing 110 and couple the elongated projections 114 at the opposite ends 114. Thus, the ribs 115 contribute to the strength of the female housing 110. The ribs 115 have substantially the same height as the elongated projections 114 and allow an operator to place his fingers thereon to connect and separate the female housing 110 (see FIG. 24).

An engaging portion 116 projects in the widthwise middle of the upper surface of the female housing 110 for engaging the lock arm 143 of the male connector M. The engaging portion 116 is between the front end of the female housing 110 and the locks 113. The width of the engaging portion 116 substantially equals a width of a lock 148 of the lock arm 143. The front surface of the engaging portion 116 is slanted and slopes up towards the back. On the other hand, a rear locking surface of the engaging portion 116 extends substantially straight and vertically at an angle to the connecting direction CD.

Figure 18:
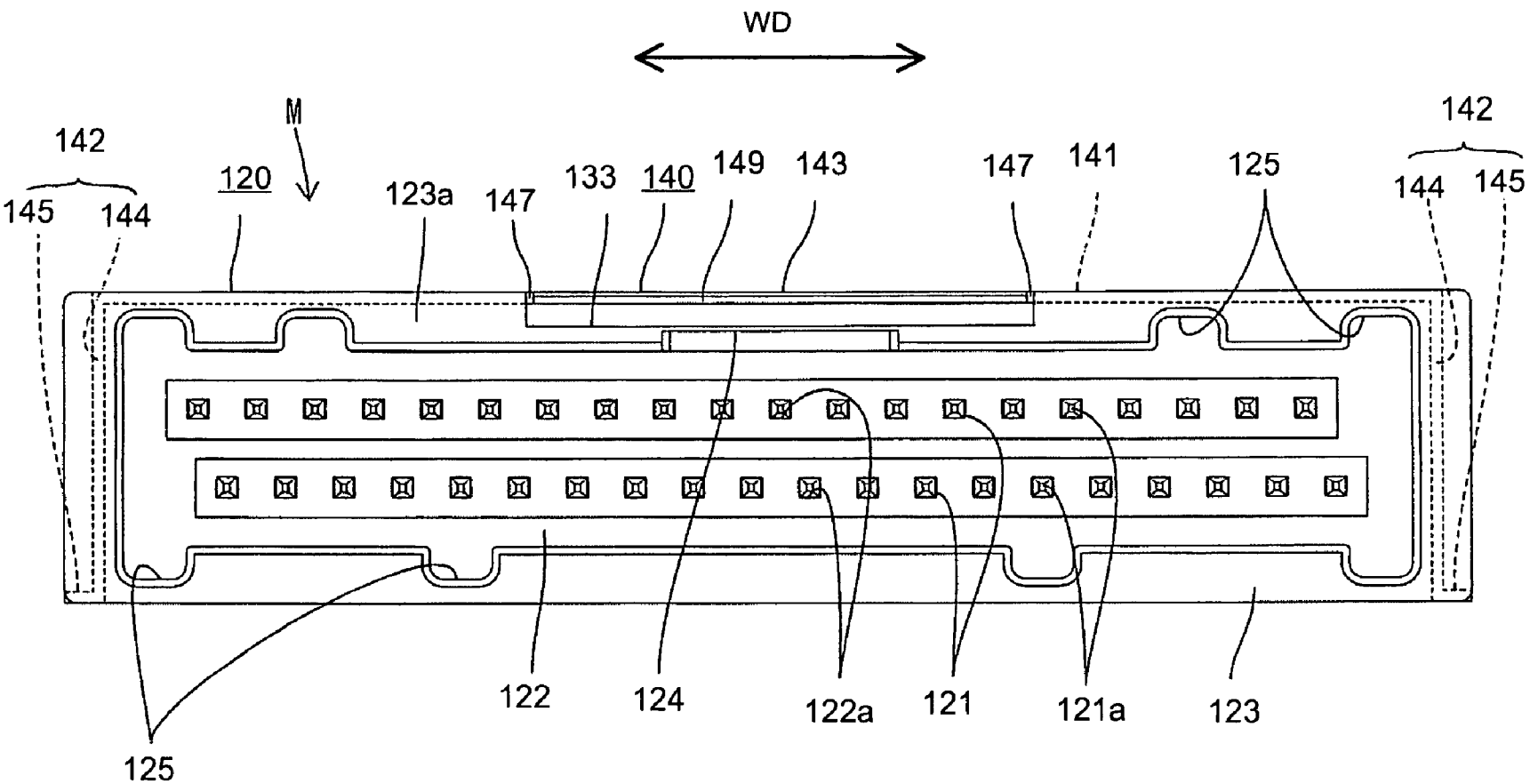
FIG. 18 is a front view of a male connector.

The male connector M is a circuit board connector to be mounted on a circuit board K, as shown in FIGS. 18 and 21, and includes a male housing 120 made e.g. of a synthetic resin. The male housing 120 is narrow and long along the width direction WD and includes a terminal holding portion 122. Twenty terminal insertion holes 122*a* are arranged substantially side by side at substantially even intervals along the width direction WD at each of upper and lower stages of the terminal holding portion 122. The terminal insertion holes 122*a* at the upper stage are displaced from the terminal insertion holes 122*a* at the lower stage along width direction WD. A substantially rectangular tubular receptacle 123 projects forward from the peripheral edge of the terminal holding portion 122. Male terminal fittings 121 are insertable into the terminal insertion holes 122*a* from the rear and along an insertion direction. A connector connecting portion 121*a* of the male terminal fitting 121 projects forward into the receptacle 123 and is electrically connectable with the female terminal fitting 111 of the female connector F. Part of each male terminal fitting 121 projecting back from the terminal holding portion 122 is bent down at substantially a right angle, and a board connecting portion 121*b* at a rear end of each male terminal fitting 121 is bent back again at substantially a right angle. The board connecting portion 121*b* is electrically connectable with a conductor path (not shown) printed on the circuit board K preferably by soldering, (ultrasonic) welding, press fitting or the like.

The female housing 110 of the female connector F is fittable into the receptacle 123 from the front and along the connecting direction CD. A receiving recess 124 is formed at a substantially widthwise middle of the ceiling surface of the receptacle 123 for receiving the engaging portion 116. Four receiving recesses 125 are formed in each of the upper and lower surfaces of the receptacle 123 for receiving the corresponding elongated projections 114. A mounting portion 126 is formed on the outer surface of the receptacle 123.

Figure 19:
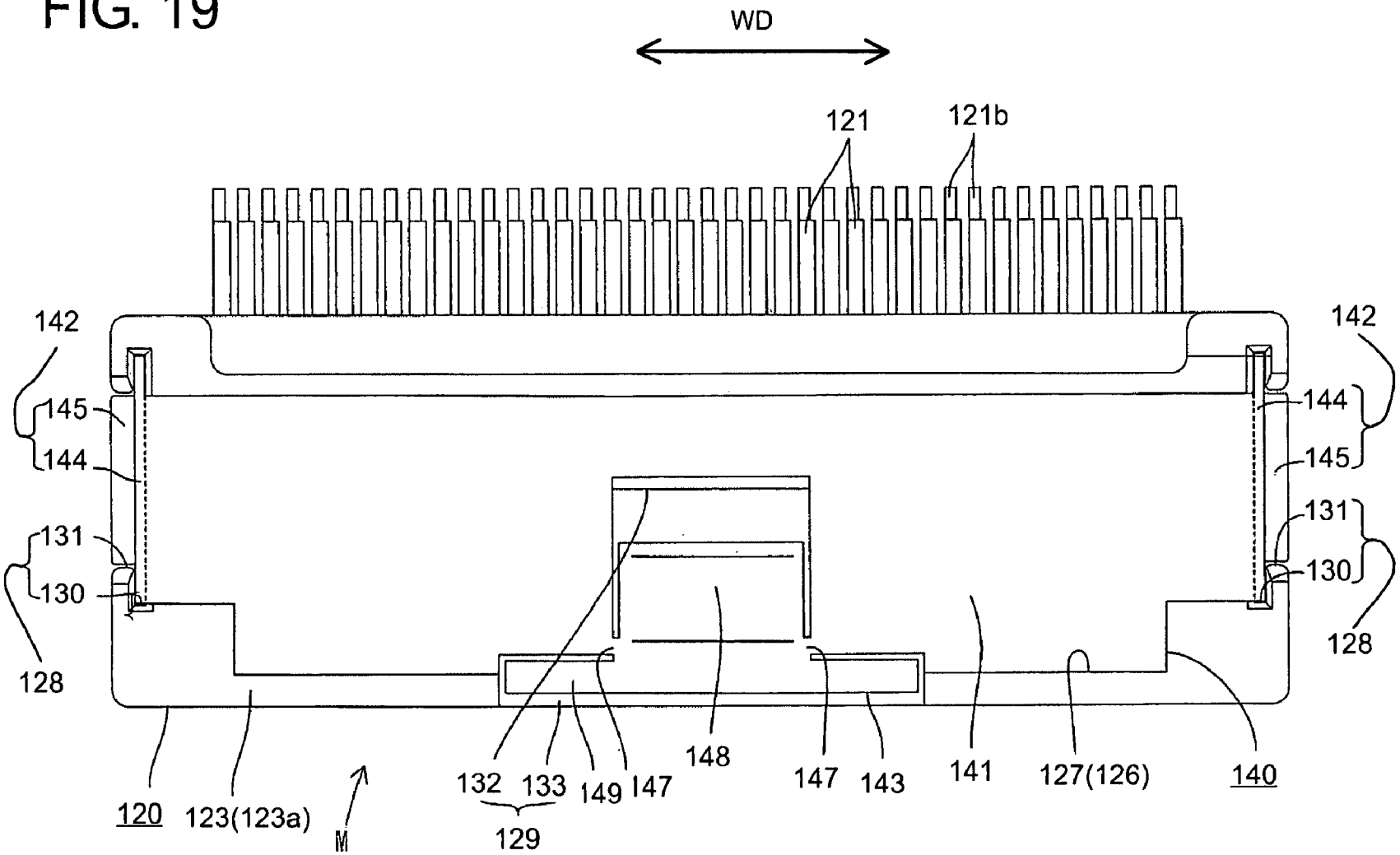
FIG. 19 is a plan view of the male connector.
Figure 20:
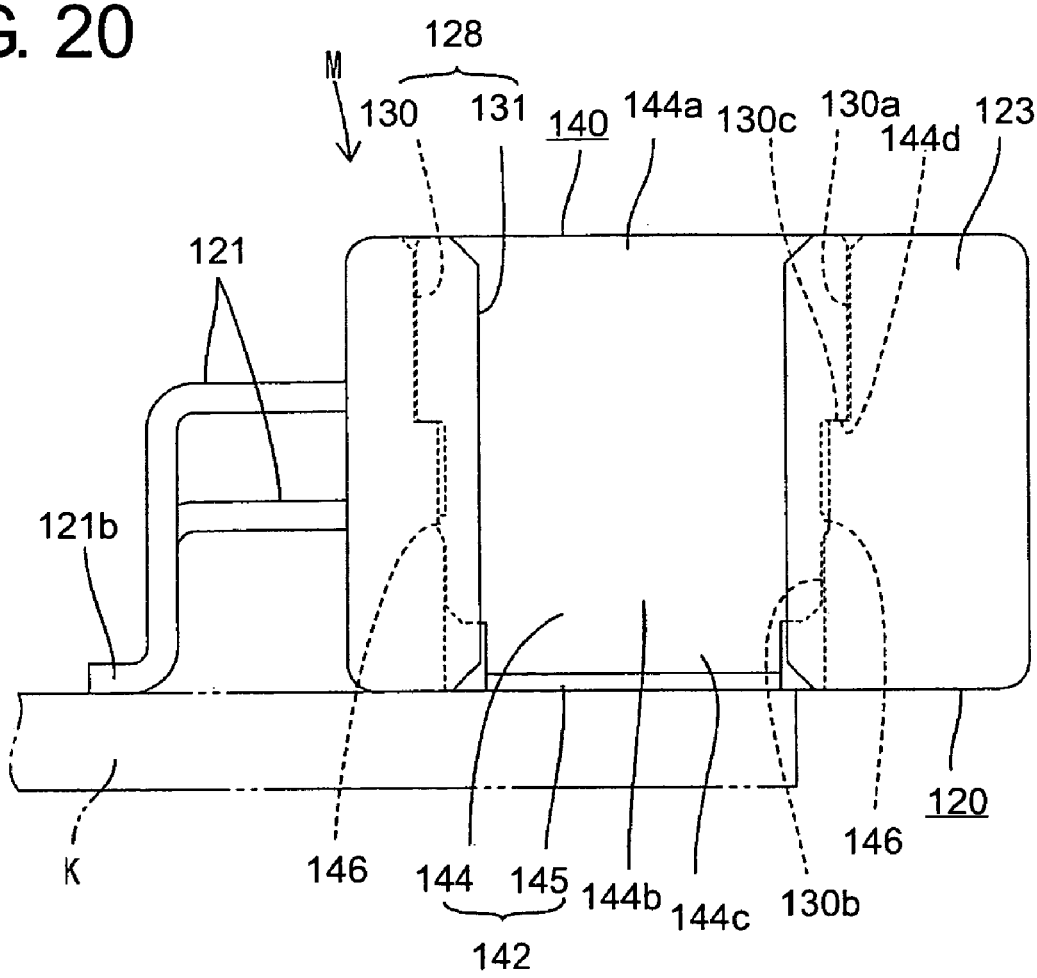
FIG. 20 is a side view of the male connector.

A metallic member 140 is formed by bending, folding and/or embossing a metal plate stamped or cut into a specified shape from a metal or metal-like material. The metallic member 140 has a main portion 141 at least partly covering the upper surface of the receptacle 123, as shown in FIGS. 18 to 20. Two fixing portions 142 project down substantially normal from the opposite lateral edges of the main portion 141 and cover the side surfaces of the receptacle 123. A lock arm 143 is formed on the main portion 141. On the other hand, the mounting portion 126 includes a mounting recess 127 in the upper surface of the receptacle 123 and two mounting grooves 128 in the opposite side surfaces of the receptacle 123 and a lock-arm arranging space 129 in an upper part 123*a* of the receptacle 123.

The main portion 141 is a substantially flat plate that extends in a width direction WD over substantially the entire width of the upper surface of the receptacle 123. The mounting recess 127 is formed over substantially the entire width of the upper part 123*a* of the receptacle 123 and has a depth substantially equal to the thickness of the main portion 141. Thus, the upper surface of the mounted main portion 141 is substantially flush with the upper surface of the receptacle 123 (see FIG. 18).

Each fixing portion 142 has a housing fixing portion 144 and a board fixing portion 145 arranged in a substantially L-shape, as shown in FIG. 18. The housing fixing portion 144 extends vertically over substantially the entire height of the side surface of the receptacle 123. The board fixing portion 145 projects sideways from the bottom end of the housing fixing portion 144. As shown in FIG. 20, each mounting groove 128 is formed over substantially the entire height of the side of the receptacle 123 and includes upper and lower sections 130 and 131. The upper section 130 of each mounting groove 128 penetrates the side of the receptacle 123 and accommodates the housing fixing portion 144. The lower section 131 of each mounting groove 128 is an opening made in the side of the receptacle 123 and accommodates the board fixing portion 145. The housing fixing portion 144 has a stepped configuration with a wide upper panel 144*a*, an middle panel 144*b* and a narrow bottom panel 144*c*. The board fixing portion 145 has substantially the same width as the bottom panel 144*c*. On the other hand, the upper section 130 of each mounting groove 128 has a wide portion 130*a* and a narrow portion 130*b* one over the other. The wide portion 130*a* is at least as wide as the upper panel 144*a* of the housing fixing portion 144 and the narrow portion 130*b* is at least as wide as the middle panel 144*b*. The lower section 131 of each mounting groove 128 is at least as wide as the bottom panel 144*c* of the main portion 141 and the board fixing portion 145. Two retainers 146 project sideways from the opposite lateral edges of the middle panel 144*b* of the housing fixing portion 144. The retainers 146 bite in the edges of the narrow portions 130*b* as the metallic member 140 is mounted to retain the metallic member 140 on the male housing 120. The board fixing portions 145 are fixed to the circuit board K by soldering, welding, press-fitting or the like. The projecting ends of the board fixing portions 145 are substantially flush with the side surfaces of the receptacle 123.

As shown in FIGS. 19 and 21, the lock arm 143 is a metallic piece formed by making a slit in the main portion 141 of the metallic member 140. The lock arm 143 includes supports 147 coupled to the opposite inner edges of the main portion 141. A lock 148 projects back from the supports 147 and an operable portion 149 projects forward from the supports 147. The lock 148 has an inclined portion that slopes down and back towards the male housing 120 and a substantially horizontal portion that extends rearward from the inclined portion. The rear surface of the engaging portion 116 is engageable with the rear edge of the horizontal portion. The front surface of the inclined portion of the lock 148 is slanted substantially parallel to the front surface of the engaging portion 116. The operable portion 149 is substantially horizontal over and is about twice as wide as the lock 148. The lock arm 143 can resiliently undergo a seesaw-like rocking movement about the supports 147 so that the operable portion 149 and the lock 148 displace in opposite directions 1DD and 2DD. For example, the lock 148 can be displaced out and away from the male housing 120 in a displacement direction 1 DD while the operable portion 149 is displaced in towards the male housing 120 in a displacement direction 2DD (see FIG. 22). Accordingly, when the operable portion 149 is pressed down towards the male housing 120 (direction 2DD), the lock 148 is displaced up away from the male housing 120 (direction 1DD), i.e. unlocking direction.

The upper part 123*a* of the receptacle 123 has a lock-arm space 129 for accommodating the lock arm 143. The lock-arm space 129 includes a lock accommodating portion 132 and an operator-accommodating portion 133. The lock-accommodating portion 132 is a substantially rectangular hole that vertically penetrates a substantially widthwise middle of the upper part 123*a* of the receptacle 123. The operator-accommodating portion 133 is formed by thinning a front end of the upper part 123*a* of the receptacle 123. The lock-accommodating portion 132 communicates with the operator-accommodating portion 133 and the receiving recess 124.

The lock 148 is in the lock-accommodating portion 132 when the lock arm 143 is in the lock-arm space 129. Additionally, the operable portion 149 is in the operator-accommodating portion 133 and the supports 147 contact a bottom surface 133*a* of the operator-accommodating portion 133. The bottom surface 133*a* of the operator-accommodating portion 133 slopes down towards the front. Thus, a clearance is defined between the bottom surface 133*a* and the operable portion 149 for permitting the inclination of the operable portion 149 in the displacement direction 2DD. The operable portion 149 contacts the bottom surface 133*a* before the lock arm 143 is deformed beyond its resiliency limit. Thus, the operable portion 149 cannot be pressed excessively. In the accommodated state, the upper surfaces of the operable portion 149 and the receptacle 123 are substantially flush, and the bottom end surface of the rear end of the lock 148 is substantially flush with the ceiling surface of the receptacle 123. In other words, the lock arm 143 is at substantially the same position as the upper part 123*a* of the receptacle 123 with respect to the height direction. The metallic member 140 is accommodated entirely in the mounting portion 126 and does not project out from the outer peripheral surface of the male housing 120. Portions of the metallic member 140 near the supports 147 and the operable portion 149 of the main portion 141 are accommodated in the operator accommodating portion 133.

The main portion 141 of the metallic member 140 fully covers the upper surface of the upper part 123*a* of the receptacle 123 to compensate for a reduction in the strength of the upper part 123*a* resulting from the formation of the lock-arm arranging space 129. In other words, the main portion 141 also functions as a reinforcing portion.

The male terminal fittings 121 are inserted into the corresponding terminal insertion holes 122*a* from behind and along the inserting direction. The metallic member 140 then is mounted to the mounting portion 126 from above. Steps 144*d* at the bottom ends of the upper panels 144*a* of the housing fixing portions 144 contact steps 130*c* at the bottom ends of the wide upper sections 130*a* of the mounting groove 130 when the metallic member 140 is pushed to a proper depth, as shown in FIG. 20. Thus, further insertion of the metallic member 140 is prevented. Additionally, the lower surfaces of the board fixing portions 145 are substantially flush with the bottom surface of the male housing 120 and the upper surfaces of the main portion 141 and the receptacle 123 are substantially flush. The retaining portions 146 bite into the edges of the narrow lower sections 130*b* to prevent an upward detaching movement of the metallic member 140. The insertion of the male terminal fittings 121 can be carried out before or after the mounting of the metallic member 140.

The male housing 120 is placed on the circuit board K so that both board fixing portions 145 are at positions where they are planned to be fixed to the circuit board K. Molten solder then is attached to the peripheral edges of both board fixing portions 145 and solidified to fix the male connector M to the circuit board K. Subsequently, the board connecting portions 121*b* of the male terminal fittings 121 are soldered successively to the corresponding conductor paths on the circuit board K.

Figure 22:
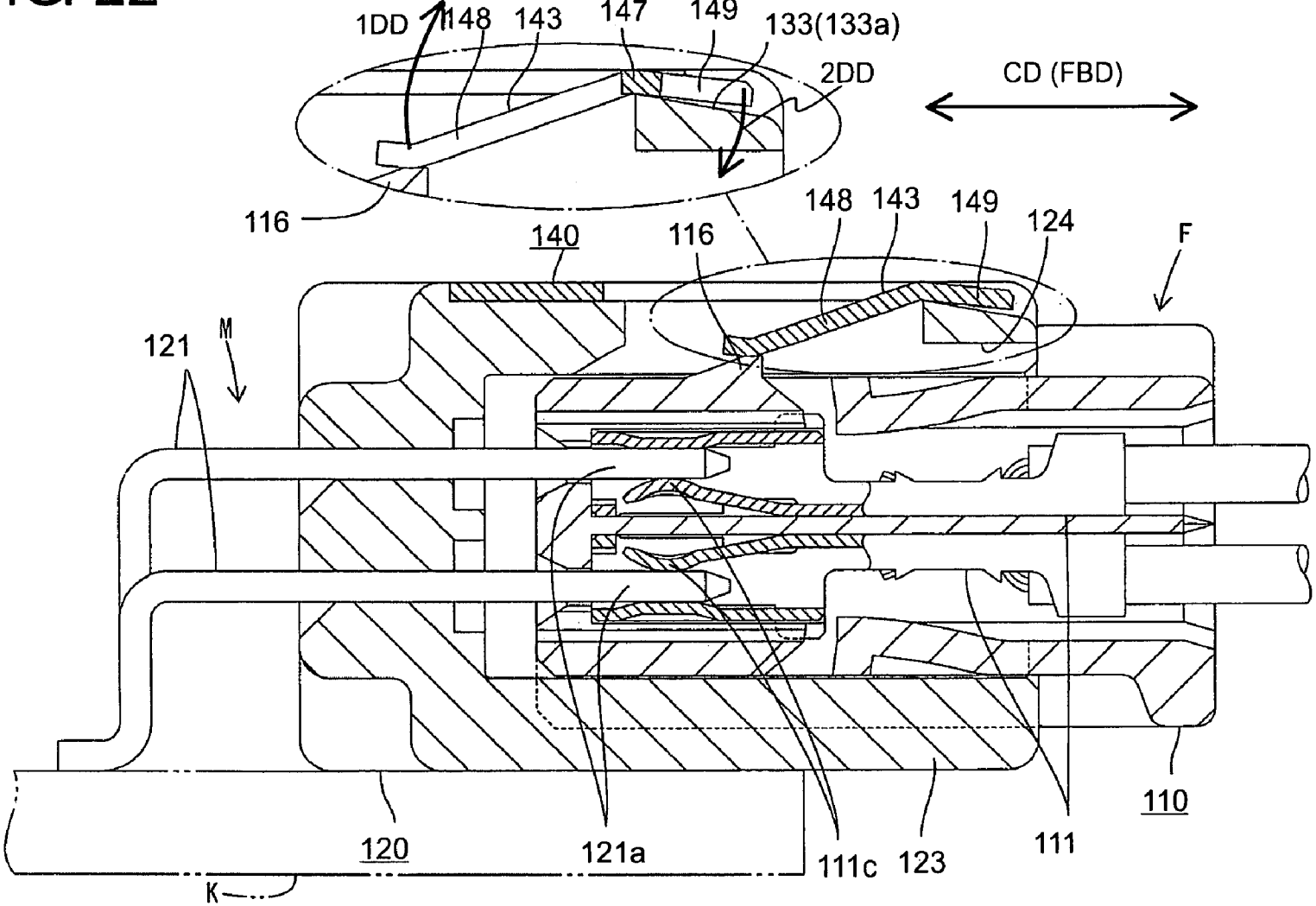
FIG. 22 is a side view in section showing an intermediate stage of the connection of the two connectors.
Figure 23:
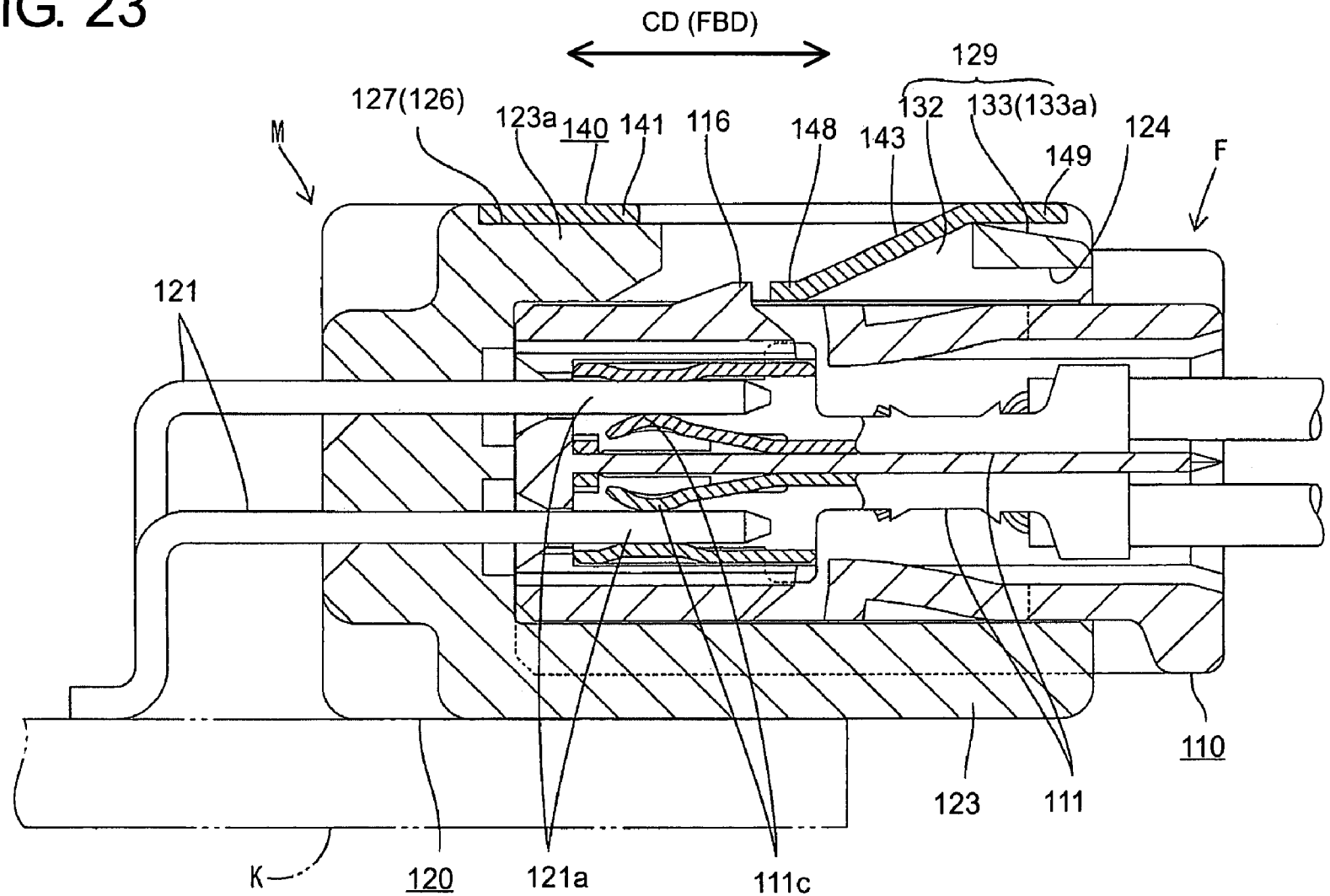
FIG. 23 is a side view in section showing a state where the two connectors are properly connected.

The assembled female connector F then is connected with the male connector M fixed to the circuit board K. More particularly, the female housing 120 is fit into the receptacle 123 of the male housing 120 along the connecting direction CD from the state shown in FIG. 21. Thus, the elongated projections 114 enter the appropriate receiving recesses 125 to guide the connecting operation smoothly. The slanted front surface of the lock 148 and the slanted front surface of the engaging portion 116 slide in contact with each other when the female housing 110 is connected to a specified depth. Thus, the lock arm 143 undergoes a resilient seesaw-like displacement about the supports 147, as shown in FIG. 22. The lock 148 moves onto the engaging portion 116 and is displaced up in the displacement direction 1DD. Simultaneously, the operable portion 149 is displaced down in the displacement direction 2DD, as shown in the enlarged view in FIG. 22. The engaging portion 116 reaches a position behind the lock 148 when the female housing 110 is connected to a proper depth. Thus, the lock arm 143 is restored resiliently so that the rear edge of the lock 148 engages the rear surface of the engaging portion 116, as shown in FIG. 23, to connect the connectors F, M securely together. At this time, the resilient contacts 111*c* of the female terminal fittings 111 are held properly in resilient contact with the connector connecting portions 121*a* of the male terminal fittings 121.

Figure 24:
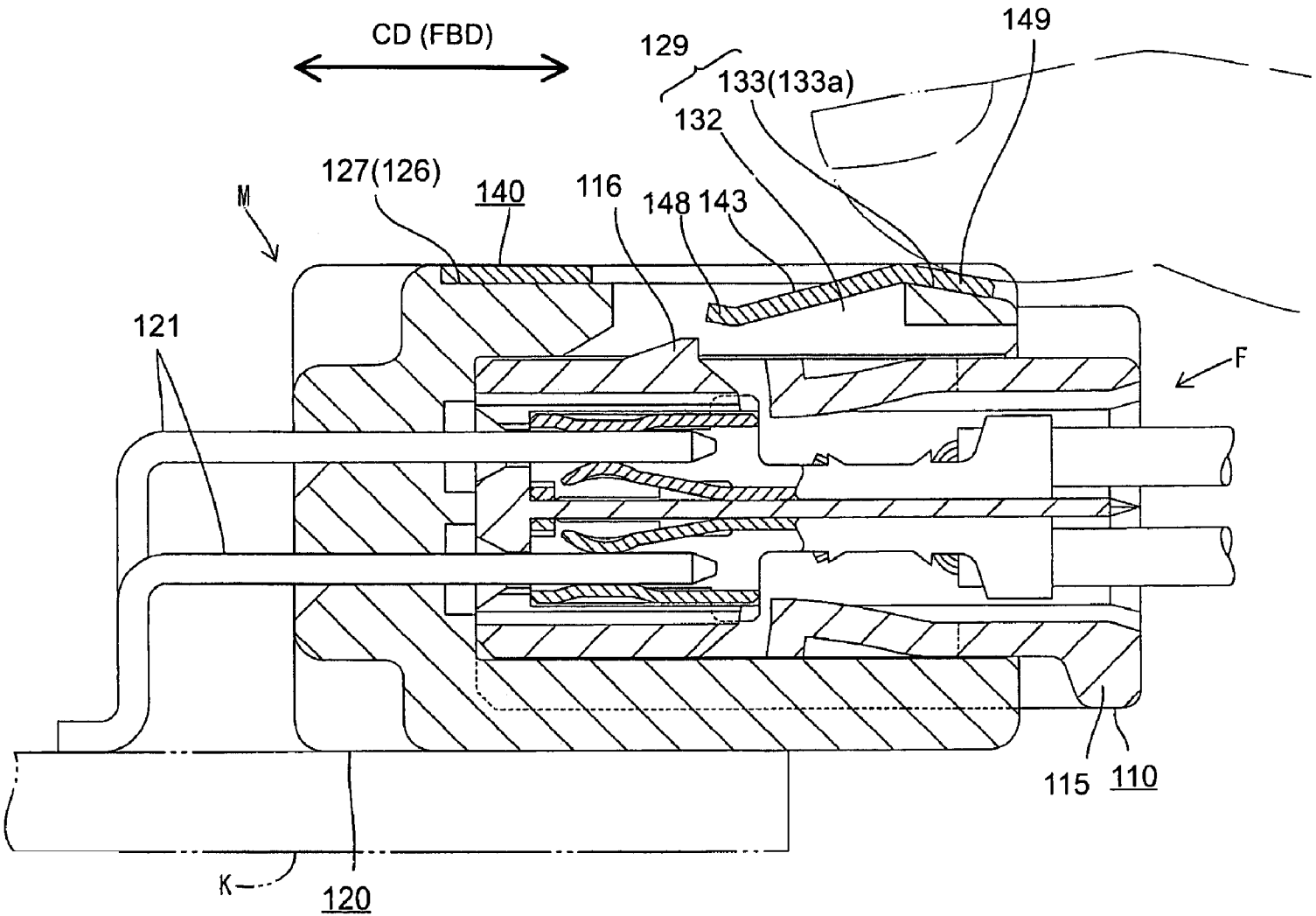
FIG. 24 is a side view partly in section showing a state where an operable portion is pressed at the time of separating the two connectors.
Figure 25:
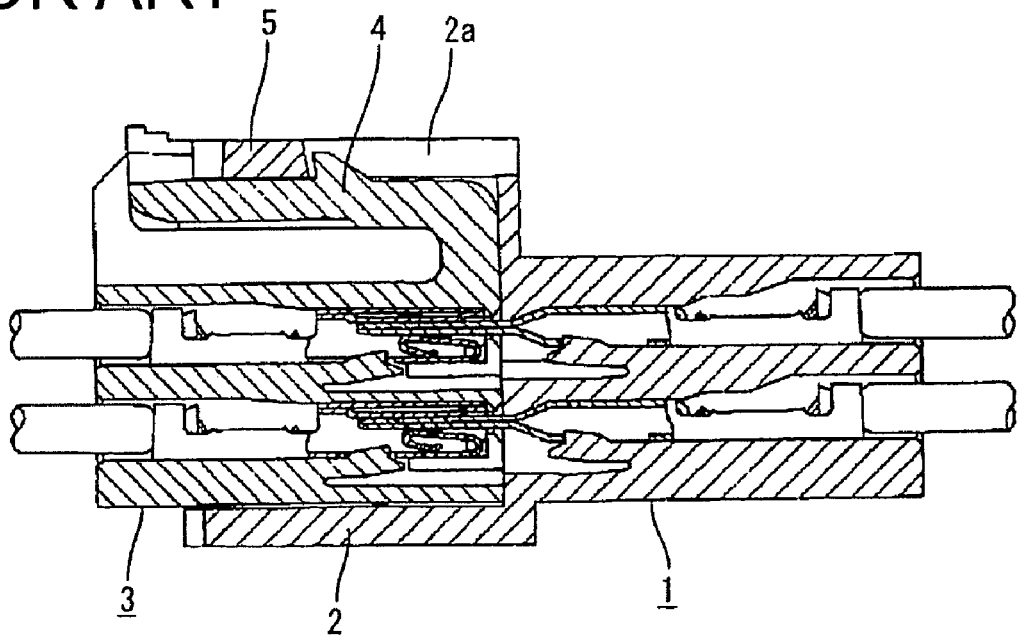
FIG. 25 PRIOR ART
FIG. 25 is a section of a prior art connector.

The female connector F may have to be separated from the male connector M for maintenance or other reason. In such cases, the operable portion 149 is pressed from above. As a result, the lock arm 143 undergoes a seesaw-like displacement about the supports 147, as shown in FIG. 24. This seesaw movement causes the lock 148 to displace up in the displacement direction DD1 and gradually reduces an area of engagement with the engaging portion 116. The supports 147 contact the bottom surface 133*a* of the operator accommodating portion 133 for support. The female housing 110 is pulled back while the operable portion 149 is pressed sufficiently for the lock 143 to disengage from the engaging portion 116. Thus, the female connector F can be separated easily from the male connector M by manually gripping the ribs 115 of the female housing 110. An attempt could be made to press the operable portion 149 excessively. However, the operable portion 149 contacts the bottom surface 133*a* of the operator accommodating portion 133 to prevent further displacement. Therefore, the lock arm 143 cannot be deformed plastically.

As described above, the receptacle 123 of the male housing 120 is cut to form the lock-arm arranging space 129 and the metal lock arm 143 is arranged therein. Thus, the male connector M is smaller than connectors where a receptacle and a lock arm are one over the other along height direction.

Further, the lock arm 143 is formed to undergo a seesaw-like displacement or rocking movement. The lock 148 is at the rear end of the lock arm 143 and the operable portion 149 is at the front end thereof. Thus, the lock arm 143 can be inclined by operating the operable portion 149 to disengage the lock 148 from the engaging portion 116.

The main portion 141 is made of a metal plate and covers the outer surface of the upper part 123*a* of the receptacle 123 where the lock-arm arranging space 129 is formed. Thus, the metal main portion 141 offsets a reduction in the strength of the male housing 120 resulting from the formation of the lock-arm arranging space 129. In addition, the main portion 141 is unitary with the lock arm 143. Thus, the construction can be simplified. The construction is simplified further because the board fixing portions 145 are integral to the main portion 141 via the housing fixing portions 144.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The mounting surface for the lock arm is not limited to the upper surface of the female housing, and may be at the lower surface of the female housing or another outer surface such as the side surface or the front surface where the locks do not project.

The locks are displaced up to the arrangement space for the lock arm during the resilient deformation in the foregoing embodiments. However, the invention also applies to connectors where the locks are not displaced up to an arrangement space for a lock arm, i.e. deformation spaces for the locks can be shared only as a deformation space for the lock arm.

The locks project out during the resilient deformation in the foregoing embodiments. However, the invention is also applicable to connectors in which locks do not project out during resilient deformation.

The shape of the lock arm can be changed. For example, a press-in portion could be at an intermediate position of the arm portion to make the lock arm tooth- or seesaw-shaped or the press-in portions could be at both front and rear ends to support the lock arm at both ends. Further, the lock arm could be made of a metal other than the stainless steel.

The shape of the lock-arm arranging space can also be changed. For example, the lock accommodating portion may not penetrate the upper part of the receptacle and, instead, may have an open front or rear end. Further, the lock-arm arranging space may be in a different position.

The lock arm is unitary to the main portion covering the outer surface of the male housing in the foregoing embodiment. However, it may be separate from the main portion. Further, the main portion and the fixing portions of the metallic member may be omitted and the male housing may be provided only with the lock arm.

Screws or means other than soldering may fix the male connector to the circuit board. In such a case, the board fixing portions of the metallic member can be omitted. Further, the invention is not limited to connectors fixed to circuit boards, but is also applicable to connectors at ends of wires or fixed to other devices such as a junction box, computer, etc.

The lock arm may be on either the male connector or the female connector according to the invention. Further, the number and arrangement of the terminal fittings may be changed, and the shape of the female connector can be changed.

What is claimed is:

1. A connector for connection with a mating connector, the mating connector having a mating housing made of a synthetic resin and mating terminal fittings therein, the connector comprising:

a housing made of a synthetic resin and have a terminal fittings therein for connection with the mating terminal fittings when the connector and the mating connector are connected; and a lock arm having a projection for engaging the mating housing and holding the mating connector in a connected state with the connector, the lock arm being made of metal and being pressingly held on the housing at a location spaced from the terminal fittings and at least partly in a lock-arm arranging space recessed in the housing wherein the lock arm is configured to undergo a substantially seesaw-like deformation, wherein a substantially flat metal reinforcement covers an outer surface of a part of the housing where the lock-arm arranging space is formed, the lock arm being unitary whit the reinforcement.

2. The connector of claim 1, wherein the lock arm has at least one press-in portion projecting towards the housing, and at least one press-in groove being formed in the housing for receiving the press-in portion.

3. The connector of claim 1, a locking portion is formed at a first end of the lock arm for engaging an engaging portion of the mating connector, and an operable portion at a second end of the locking arm for canceling a locked state.

4. The connector of claim 1, wherein the housing is configured to be fixed to an electric or electronic device, and the reinforcing portion is unitary with a fixing portion to be fixed to the electric or electronic device.

5. The connector of claim 1, wherein the housing has a receptacle for receiving the mating connector, the lock arm being engageable with an engaging portion of the mating connector to hold the mating connector in a connected state.

6. The connector of claim 5, wherein the lock arm is in the lock-arm arranging space formed by recessing the receptacle.

7. A connector comprising:

housing made of synthetic resin, the housing being formed with cavities for accommodating terminal fittings, resiliently deformable locks being formed in the cavities for engaging the respective terminal fittings, the locks being configured to project out from an outer surface of the housing during resilient deformation, and a lock arm for holding a mating connector in a connected state, the lock arm being made of metal and being pressingly held on the housing and at least partly in a lock-arm arranging space recessed in the housing, the lock arm being mounted on the outer surface of the housing from which the locks project during the resilient deformation.

8. The connector of claim 7, wherein the lock arm substantially faces the locks and is retracted into deformation spaces for the locks during the resilient deformation.

* * * * *